US005965847A

United States Patent [19]

Tanaka et al.

[11] Patent Number: 5,965,847

[45] Date of Patent: Oct. 12, 1999

[54] SHIELD CONNECTOR

[75] Inventors: Tsutomu Tanaka; Nori Inoue, both of Yokkaichi, Japan

[73] Assignee: Sumitomo Wiring Systems, Ltd., Japan

[21] Appl. No.: 08/966,475

[22] Filed: Nov. 7, 1997

[30] Foreign Application Priority Data

| | | | |
|---|---|---|---|
| Nov. 12, 1996 | [JP] | Japan | 8-300649 |
| Nov. 12, 1996 | [JP] | Japan | 8-300650 |
| Nov. 14, 1996 | [JP] | Japan | 8-303359 |

[51] Int. Cl.[6] ..... H01R 4/00

[52] U.S. Cl. ..... 174/84 R; 174/88 C; 174/86; 439/607; 439/608; 439/610

[58] Field of Search ..... 174/84 R, 74 R, 174/93, 86, 88, 88 R; 439/607, 608, 610, 585

[56] References Cited

U.S. PATENT DOCUMENTS 5,501,615 3/1996 Inaba et al. ..... 439/578

*Primary Examiner*—Kristine Kincaid
*Assistant Examiner*—William H Mayo, III
*Attorney, Agent, or Firm*—Anthony J. Casella; Gerald E. Hespos

[57] ABSTRACT

A shield layer 13 of a shielded cable W and a metal shell 30 are electrically connected via a connection member 40. This connection member 40 is tubular and includes a receiving portion 41 which is insertable under the shield layer 13, a shield layer fastening portion 42 for fastening the shield layer 13 to the receiving portion 41, and a contact portion 43 to be brought into pressing contact with the inner circumferential surface of the metal shell 30. The portions 41 to 43 are integrally or unitarily formed. With this construction, if the shield layer fastening portion 42 is fastened after the receiving portion 41 is inserted under the shield layer 13, the shield layer 13 is tightly held between the receiving portion 41 and the fastening portion 42. As a result, the shield layer 13 and the metal shell 30 are connected electrically even if the rigidity of an insulation layer 12 is reduced.

4 Claims, 20 Drawing Sheets

SHIELD CONNECTOR

BACKGROUND OF THE INVENTION

1. Field of the Invention

The present invention relates to a shield connector to be connected with a shielded cable.

2. Description of the Prior Art

A known shield connector is disclosed in Japanese Unexamined Patent Publication No. 7(HEI)-245153. This connector is described below with reference to FIG. 24.

A shielded cable is identified by W in FIG. 24. A sheath is peeled off at an end of the shielded wire W, thereby exposing a core A1 and a shield layer A2 formed by a braided wire. With the core A1 is connected a male terminal fitting A3. A tubular metal shell A4 is fitted to cover the cable end and the terminal fitting A3, and a rear end thereof (left end in FIG. 24) is forcibly fastened to the shield layer A2. Thereby, the shield layer A2 and the metal shell A4 are electrically connected, forming a shield for the male terminal fitting A3. Although unillustrated, the male terminal fitting A3 and the metal shell A4 are accommodated in a housing.

Since an insulation layer A5 between the core A1 and the shield layer A2 is made of a synthetic resin material, upon being subjected to a high temperature due to heat generated by the core A1, the insulation layer A5 has a reduced rigidity and is liable to be deformed. Accordingly, with the above construction in which the metal shell is forcibly fastened to the shield layer, sealability between the shield layer and the metal shell may be reduced by the reduced rigidity of the insulation layer 5, resulting in an unstable electrical connection.

A further known shield connector of this type is shown in FIGS. 25 and 26.

In FIG. 25, identified by W is a shielded cable. A sheath is peeled off at an end of the shielded wire W, thereby exposing a core B1 and a shield layer B2 formed by a braided wire. A holder B4 provided with a connection fitting B3 is mounted on the end of the shielded cable W and a tubular metal shell B5 (shield tube) is fitted outside the holder B4. This connection fitting B3 is to be electrically connected with the shield layer B2 and the metal shell B5, and opposite ends thereof serve as pressing pieces B3A for holding the shield layer B2 therebetween. Bottom ends of the holding pieces B3A are connected into a mount portion B3B to be mounted on the holder B4.

The holding pieces B3A are open when the holder B4 is mounted on the end of the shielded cable W as indicated by solid line in FIG. 26. When the metal shell B5 is fitted outside the holder B4, upper ends B3C are guided into a fastening slot B5A formed at the opening edge of the metal shell B5. In other words, a distance between the holding pieces B3A is gradually narrowed as the metal shell B5 is mounted. Accordingly, the shield layer B2 is held by the pressing pieces B3A, with the result that the shield layer B2 and the metal shell B5 are electrically connected via the connection fitting B3.

However, with the above construction, the upper ends of the pressing pieces have to be fitted into the fastening slot of the metal shell. Accordingly, an operator has to mount the metal shell while confirming the position of the upper ends of the pressing portions with respect to the fastening slot. This leads to a poor operability. Further, since the pressing pieces are open before the metal shell is fitted, the holder easily rotates with respect to the shielded cable, making it more difficult to fit the upper ends of the pressing portions into the fastening slot.

In view of the above problem, an object of the present invention is to provide an improved shield connector, being particularly capable of securely holding a shield tube and a shield layer electrically connected.

SUMMARY OF THE INVENTION

According to the invention, there is provided a shield connector comprising a housing for substantially accommodating an end of a shielded cable in which a core is covered by a shield layer. The cable also includes an insulation coating interposed or arranged between the core and the shield layer. A shield tube is provided in which the core is substantially shielded by electrically connecting the shield tube and the shield layer. The connector comprises a connection member for electrically connecting the shield layer and the shield tube. The connection member comprises at least one receiving member which is at least partially inserted between the insulation coating of the core and the shield layer, and one or more pressing members or portions for pressing the shield layer against the receiving member.

Since the shield layer is held between the receiving member and the pressing members, the shield layer and the connection member are held in contact even if the rigidity of the insulation layer is reduced, thereby ensuring a secure electrical connection of the shield layer and the shield tube.

According to a preferred embodiment of the invention, the pressing members press the shield layer against the receiving member substantially by a lever action in which a point or portion of connection with the receiving member acts as a fulcrum and the other end of the pressing member acts as a point of action.

Preferably, the one or more pressing members each have a conductive property and have one end thereof connected with the receiving member.

According to a further preferred embodiment, there is provided a shield connector comprising a housing for accommodating an end of a shielded cable in which a core is covered by a shield layer and the shield layer is covered by an insulation coating. A shield tube is provided in the housing so as to cover the core projecting forward from the shield layer. The core is shielded by electrically connecting the shield tube and the shield layer. The shield connector comprises a connection member for electrically connecting the shield layer and the shield tube. The connection member comprises a receiving member which is inserted between the insulation coating of the core and the shield layer. Two pressing members also are provided. Each pressing member has a conductive property and has one end connected with the receiving member for pressing the shield layer against the receiving member by a lever action in which a point of connection with the receiving member acts as a fulcrum and the other end of the pressing member acts as a point of action.

Accordingly, the receiving member is inserted or insertable under the shield layer to electrically connect the shield tube and the shield layer. Further, the pressing members are elastically deformed by the lever action. Then, the shield layer is strongly pressed against the receiving member by the base portions of the pressing members. As a result, the shield layer is electrically connected with the connection member and, thus, with the shield tube.

Since the shield layer is held between the receiving member and the pressing members, the shield layer and the connection member are held in contact even if the rigidity of the insulation layer is reduced, thereby ensuring a secure electrical connection of the shield layer and the shield tube. Further, since the shield layer is pressed against the receiving member taking advantage of the action of lever, the pressing operation can be very easily performed.

Preferably, at least one engaging projection and at least one engaging recess, which are engageable with each other, are provided in base portions of the pressing members and the receiving member, preferably in positions where the base portions face each other. Accordingly, the shield layer can be more securely held by the engaging projection and the engaging recess upon being pressed against the receiving member, thereby being more securely held in contact with the connection member.

The receiving member may be formed to have a substantially tubular shape extending substantially along the inner circumferential surface of the shield layer. Additionally, the pressing members are formed integrally or unitarily with the receiving portion so as to substantially face the receiving portion. Furthermore, the pressing members preferably are formed with at least one lock portion and at least one engaging portion which are engaged while pressing the shield layer to hold the pressing members in their pressing positions.

Accordingly, when the shield layer is pressed against the receiving member by both pressing members which are so formed as to be opposite to each other, the lock portion and the engaging portion provided in the pressing members are engaged with each other. Consequently the pressing members can be held in their pressing positions. With this construction, the pressing members are not inadvertently restored to their original positions after pressing the shield layer, thereby ensuring a more secure contact. Further, since the pressing members and the receiving member are integrally or unitarily formed, the number of parts can be reduced, which is advantageous in terms of an economic aspect including costs for molds, parts management and the like.

Most preferably, the receiving member is formed to have a substantially tubular shape extending along the inner circumferential surface of the shield layer and the pressing members are formed by making cuts in the receiving member and bending the cut portions substantially outwardly. Accordingly, since the pressing members are formed by making cuts in the tubular receiving member and bending the cut portions outward, they can be easily formed.

According to a further preferred embodiment, the connection member comprises a contact portion which is to contact the shield tube. The receiving portion, the pressing portion and the contact portion preferably are formed integrally or unitarily.

According to a still further preferred embodiment, the shield connector comprises a housing for accommodating an end of a shielded cable in which a core is covered by a shield layer and the shield layer is covered by an insulation coating. A shield tube is provided in the housing so as to cover the core projecting forwardly from the shield layer. The core is shielded by electrically connecting the shield tube and the shield layer. The connector further comprises a connection member for electrically connecting the shield layer and the shield tube. The connection member is made of a conductive metal material and comprises a receiving portion which is locatable outside the insulation coating of the core and which is insertable under the shield layer. A pressing portion which is so arranged as to cover the shield layer and to press the shield layer against the receiving portion. A contact portion is disposed to contact the shield tube. The receiving portion, the pressing portion and the contact portion are formed integrally or unitarily.

Accordingly, the connection member is mounted at the end of the shielded cable to electrically connect the shield tube and the shield layer. Specifically, the receiving portion is inserted under the shield layer and the shield layer is pressed against the receiving portion by the pressing portion outside the shield layer. In this way, the shield layer and the connection member are electrically connected. If the shield tube is mounted on the end of the shielded cable, then the contact portion of the connection member is brought into contact with the shield tube for electrically connecting the shield layer and the shield tube.

Since the shield layer is held tightly between the receiving portion and the pressing portion, the shield layer and the connection member can be held in contact even if the rigidity of the insulation layer is reduced. Thus, the shield layer and the shield tube can be held securely in electrical connection. Further, since the receiving portion, the pressing portion and the contact portion are integrally or unitarily formed according to the invention, it is not necessary to provide a plurality of parts, which is advantageous in terms of an economic aspect including costs for molds, parts management and the like.

Preferably, the pressing portion is a fastening portion for forcibly fastening the shield layer to the receiving portion.

Accordingly, the shield layer and the connection member are brought into contact with each other by fastening the pressing portion to the shield layer after the receiving portion is inserted under the shield layer. Thus, the shield layer and the connection member can be securely brought into contact with each other.

Further preferably, the pressing portion comprises pressing pieces, preferably at substantially opposite sides for holding the shield layer.

Still further preferably, the pressing pieces are formed with at least one lock portion and at least one engaging portion which are engaged or engageable with each other while the shield layer is substantially pressed by the pressing pieces Most preferably, the pressing portion comprises pressing pieces at its opposite sides holding the shield layer. The pressing pieces are formed with a lock portion and an engaging portion which are engaged with each other while the shield layer is pressed by the pressing pieces. Accordingly, the shield layer is pressed against the receiving portion by the pressing pieces. The pressing pieces that press the shield layer are held in their states by the engagement of the lock portion and the engaging portion. This prevents the pressing pieces from being restored to their original positions after pressing the shield layer. Thus, the shield layer and the connection member can be held more securely in contact with each other.

According to the invention, there is further provided a shield connector comprising a housing for substantially accommodating an end of a shielded cable in which a core is covered by a shield layer. An insulation coating is interposed or arranged between the core and the shield layer. A shield tube, in which the core is substantially shielded by electrically connecting the shield tube and the shield layer, comprises a holding member which is mountable on the end of the shielded cable and holds a plurality of connection pieces made of conductive members in positions to at least partially enclose the shield layer. Each connection piece is formed with at least one shield layer contact portion for coming into contact with the shield layer and at least one shield tube contact portion for coming into contact with the shield tube.

According to a preferred embodiment, there is provided a shield connector comprising a housing for accommodating an end of a shielded cable in which a core is covered by a shield layer and the shield layer is covered by an insulation coating. A shield tube is provided in the housing so as to cover the core projecting forwardly from the shield layer. The core is shielded by electrically connecting the shield tube and the shield layer. The shield connector further comprises a holding member which is mountable on the end of the shielded cable and holds a plurality of connection pieces made of conductive members in positions to enclose the shield layer. Each connection piece is formed with a shield layer contact portion for coming into contact with the shield layer and a shield tube contact portion for coming into contact with the shield tube.

Accordingly, the insulating holding member is provided with a plurality of connection pieces made of conductive members. When this insulating holding member is mounted on the end of the shielded cable, the shield layer contact portions of the respective connection pieces come into contact with the exposed shield layer. As a result, the shield layer and the connection pieces are electrically connected. Thereafter, when the shield tube is mounted, the shield tube contact portions of the connection pieces come into contact with the shield tube. Thus, the shield layer and the shield tube are electrically connected via the connection pieces.

According to the invention, since the connection pieces and the shield layer are electrically connected before the shield layer is mounted, it is not necessary to provide a fastening slot in the metal shell as in the prior art. Thus there is no restriction with respect to the insertion direction of the shield tube. This improves an operability. Since the shield layer contact portions of the respective connection pieces are in contact with the shield layer with the holding member mounted, the holding member is unlikely to rotate with respect to the shielded cable, with the result that the shield tube can be more easily mounted.

Preferably, the shield layer contact portion is formed with a slanting guide surface for guiding the shield layer of the shielded cable to a contact surface of the shield layer contact portion.

Accordingly, since the shield layer contact portions are formed with the slanting guide surfaces for guiding the shield layer to the contact surfaces, they can be smoothly brought into contact with the shield layer. Thus, the holding member can be easily mounted on the end of the shielded cable.

Further preferably, a slanting guide surface for guiding the shield tube to a contact surface of the shield tube contact portion with the shield tube is provided substantially between the shield tube contact portion and the shield tube.

Accordingly, the shield tube contact portions can be smoothly brought into contact with the shield tube. Thus, the shield tube can be easily mounted.

Still further preferably, each connection piece is formed with a contact pressure assisting or reinforcing portion which is pressed by the shield tube as the shield tube is mounted to displace the shield layer contact portion toward the shield layer.

When the shield tube is mounted, the contact pressure reinforcing portions are pressed by the shield tube to displace the shield layer contact portions to the shield layer. Accordingly, the contact pressure of the shield layer contact portions against the shield layer is increased, thereby making an electrical connection between the shield layer and the connection pieces more secure.

Most preferably, the shield tube is provided in or on the housing so as to substantially cover the core projecting from the shield layer.

These and other objects, features and advantages of the present invention will become more apparent upon a reading of the following detailed description and accompanying drawings.

DETAILED DESCRIPTION OF THE PREFERRED EMBODIMENTS

Figure 5:
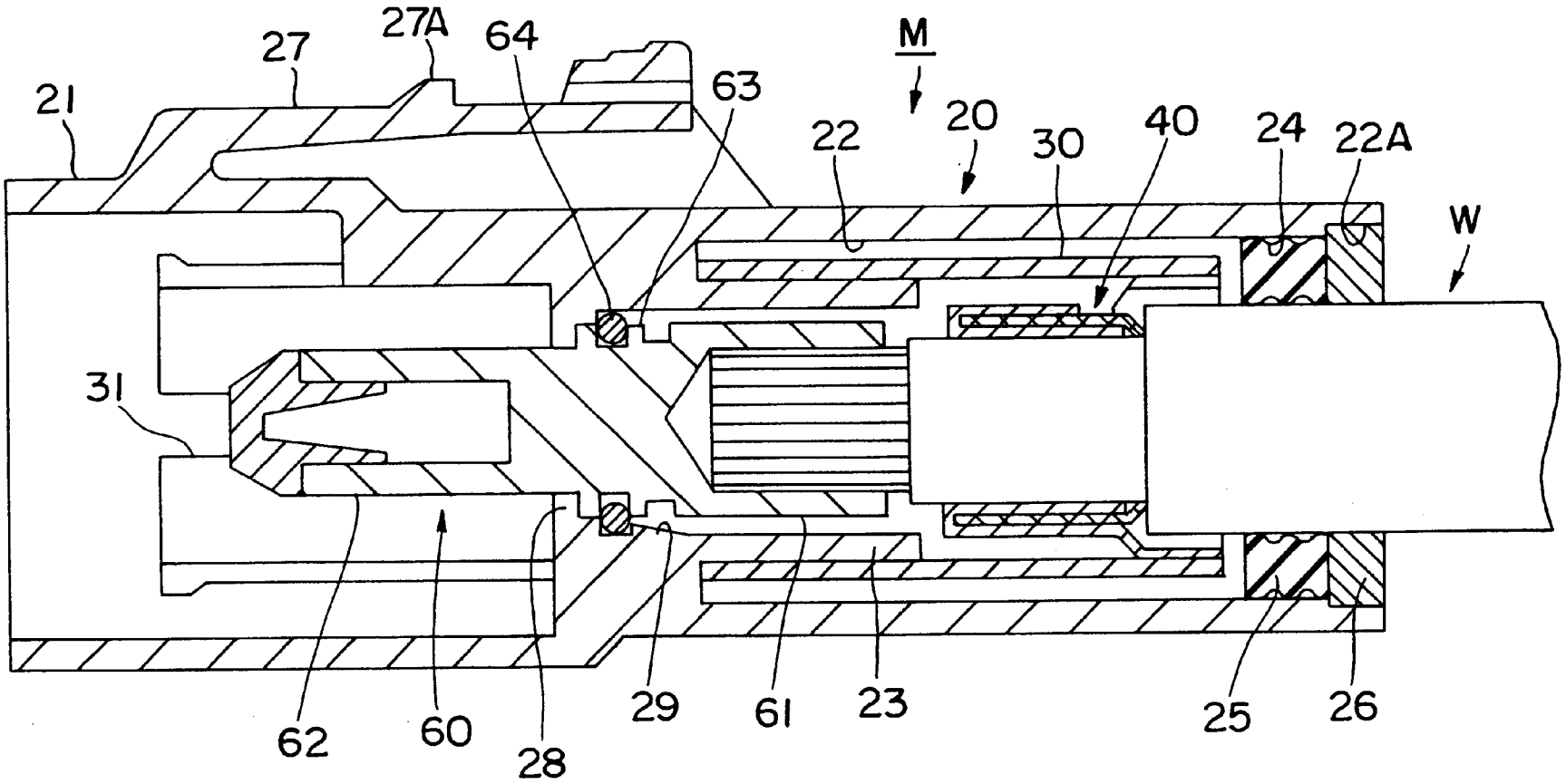
FIG. 5 is a side view in section entirely showing a shield connector according to the first embodiment.

A first embodiment of a shield connector according to the invention is described with reference to FIGS. 1 to 5. FIG. 5 is a section entirely showing the first embodiment. As shown, a shield connector M according to this embodiment is a male connector and an end of a shielded cable W is connected with this shield connector M.

Figure 1:
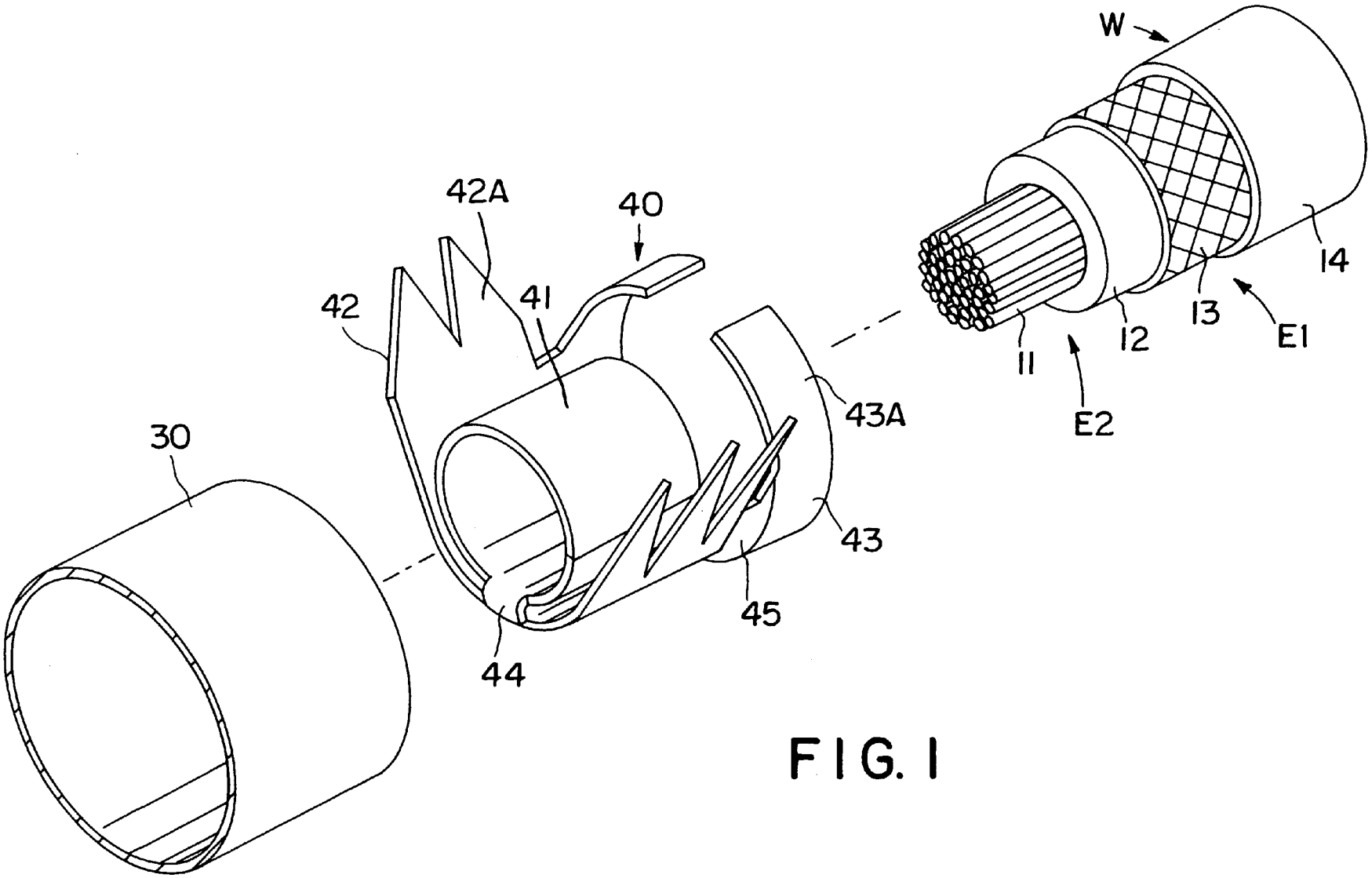
FIG. 1 is a perspective view of a shielded cable, a connection member and other elements of a first embodiment.
Figure 2:
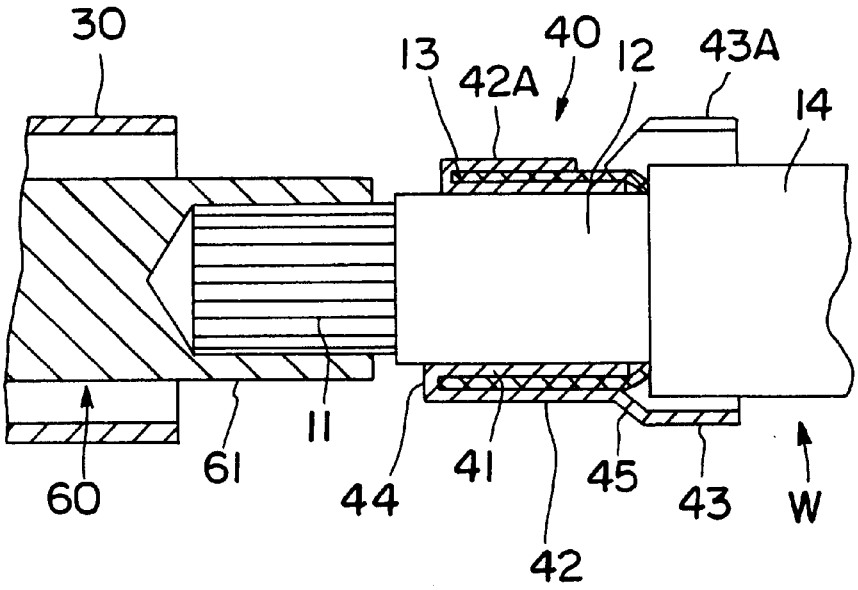
FIG. 2 is a side view in section of the first embodiment before a metal shell is mounted.
Figure 3:
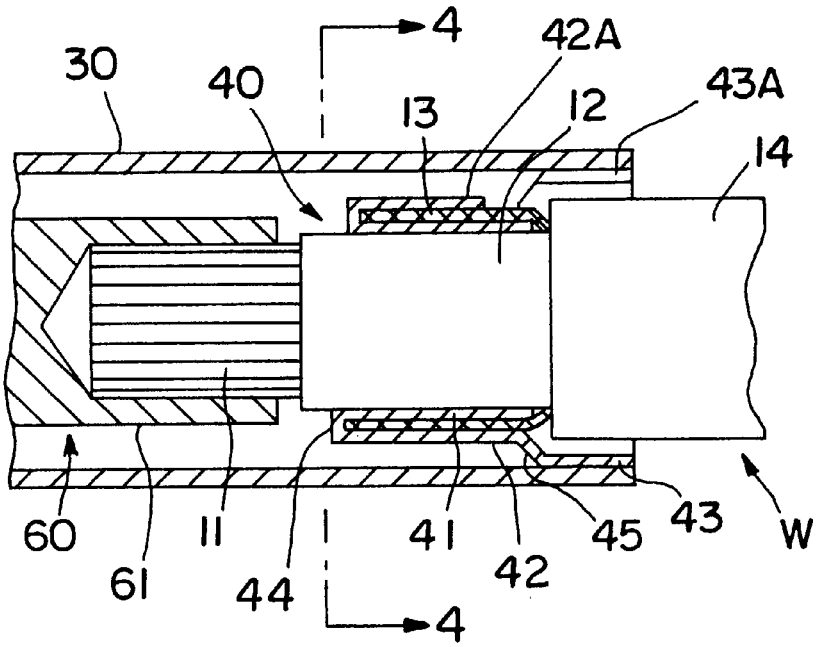
FIG. 3 is a side view in section of the first embodiment after the metal shell is mounted.
Figure 4:
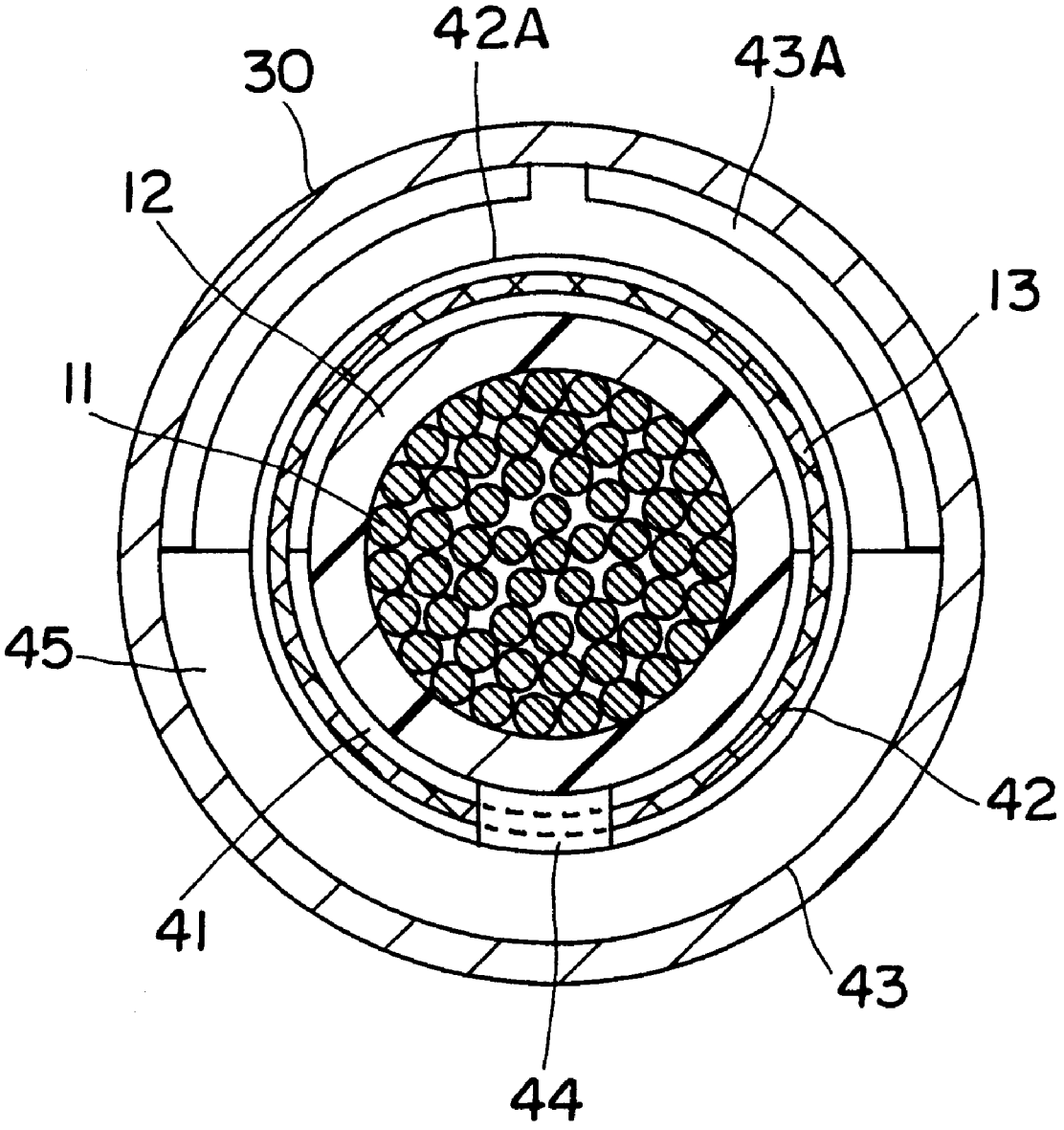
FIG. 4 is a section of the first embodiment along A—A of FIG. 3.

As shown in an upper right portion of FIG. 1, the shielded cable W is constructed such that a core 11 made of an electrically conductive material is covered by an insulation layer 12, the insulation layer 12 is covered by a shield layer 13 formed e.g. by braiding thin electrically conductive wires of metal, and the shield layer 13 is covered by an electrically insulating sheath 14. At an end portion E1 of the shielded cable W, the sheath 14 is peeled off to expose the shield layer 13. At a very end portion E2 of the shielded cable W, the insulation layer 12 is peeled off to expose the core 11.

The shield connector M, as shown in FIG. 5, comprises a housing 20, a male terminal fitting 60, a metal shell 30 or shield tube, a connection member 40 for electrically connecting the metal shell 30 and the shield layer 13. The housing 20 is made e.g. of a synthetic resin material having an electrically insulating property, and a front half (left half in FIG. 5) thereof is a receptacle 21 for accommodating an unillustrated female connector. A lock arm 27, which is elastically deformable inwardly is formed on a first surface, and preferably the upper surface of the receptacle 21. A lock projection 27A engageable with the female connector is provided on the lock arm 27.

A rear half (right half in FIG. 5) of the housing 20 is a cavity 22 used to assemble the male terminal fitting 60. The cavity 22 is preferably a round hole. Inside the cavity 22 a narrow tube 23 is provided substantially coaxially via four support arms 28 projecting from the inner surface of the cavity 22 at a preferably regular interval, e.g. an interval of substantially 90°. The male terminal fitting 60 is to be accommodated in the narrow tube 23 such that its leading end substantially projects into the receptacle 21. Further, the metal shell 30 is fitted outside the small tube 23.

The cavity 22 has an open rear end where an assembling opening 22A is defined to assemble the male terminal fitting 60, the metal shell 30 and the like. A peripheral portion of the assembling opening 22A slightly projects backwardly, thereby forming a sealing member or rubber plug accommodating portion 24. Into the rubber plug accommodating portion 24 are fitted a sealing member, e.g. a rubber plug 24 and a sealing member or rubber plug pressing lid 26 mounted on the shielded cable W to seal the cavity 22 while the shielded cable W is pulled out of the shield connector M.

The male terminal fitting 60 is e.g. bar-shaped, and a rear portion thereof serves as a core barrel 61 to be fastened to the core 11 of the shielded cable W accommodated therein. A front end portion of the male terminal fitting 60 serves as a connection portion 62 to be inserted into the unillustrated female terminal fitting. A flange 63 is formed substantially in a middle position of the outer surface of the male terminal fitting 60 with respect to its length. The flange 63 comes into engagement with the opening edge of the leading end (left opening edge in FIG. 5) of the narrow tube 23 from behind (from the right in FIG. 5). In the flange 63 is formed a ring mount groove (no reference numeral is given), in which a locking member or ring 64 is fitted or inserted. The male terminal fitting 60 is prevented from coming out by the engagement of the locking ring 64 and a locking portion 29 projecting from the inner wall surface of a lower part of the narrow tube 23.

The metal shell 30 is formed by e.g. bending a conductive metal plate into a tube. This metal shell 30 is assembled via the assembling opening 22A formed at the rear side of the cavity 22. Further, the metal shell 30 is formed with slots 31 (FIG. 5) in conformity with or corresponding to the respective support arms 28 so as to avoid interference with the support arms 28 during assembling. The slots 31 extend along the length of the metal shell 30 from the leading edge thereof.

As shown in FIG. 1, the connection member 40 is formed e.g. by bending a conductive metal plate and comprises a receiving portion 41 to be inserted under the shield layer 13, a shield layer fastening portion 42 for fastening the shield layer 13 and/or the insulating sheath 14 to the receiving portion 41, and a contact portion 43 to be brought into pressing contact with the metal shell 30. The portions 41, 42, 43 preferably are formed integrally or unitarily.

The receiving portion 41 has a preferably tubular shape and its outer diameter is substantially equal to the inner diameter of the shield layer 13. Further preferably, the length of the receiving portion 41 is set substantially equal to the length of the exposed shield layer 13. However, although unillustrated, the length of the receiving portion 41 may be such that it reaches also below the insulation sheath 14, i.e. may be longer than the length of the exposed shield layer 13.

The fastening portion 42 is formed such that a portion thereof below the receiving portion 41 has a substantially arcuate shape extending along the receiving portion 41 and opposite side portions A thereof are open upward. Further, the fastening portion 42 is coupled or connected integrally or unitarily with the bottom edge of the front end of the receiving portion 41 via a connection or coupling portion 44, with the result that an insertion space for the shield layer 13 is formed substantially between the fastening portion 42 and the receiving portion 41. A leading end of each side portion 42A of the fastening portion 42 is serrated to form engagement projections, e.g. large teeth. By bending both side portions 42A inward, the shield layer 13 inserted into the insertion space can be fastened to the receiving portion 41.

The contact portion 43 is formed to be continuous with the rear end of the fastening portion 42 and to have a diameter slightly larger than the inner diameter of the metal shell 30. Opposite substantially arcuate side pieces 43A of the contact portion 43 are made elastically and/or plastically deformable inwardly so as to come into electric, preferably elastic contact with the inner surface of the metal shell 30. A portion of the connection member 40 continuously extending from the rear edge of the fastening portion 42 to the contact portion 43 is so formed as to extend obliquely outward so as to form a portion of a truncated cone (FIG. 1). This portion serves as a slanting guide surface 45 for facilitating the mounting of the metal shell 30 on the contact portion 43 or as an insertion guide surface 45 for sustaining or guiding the insertion of the connection member 40 into the metal shell 30.

To assemble the connector, the male terminal fitting 60, the metal shell 30 and the like are mounted on the end portion of the shielded cable W.

First, the rubber plug pressing lid 26 and the rubber plug 25 are substantially fitted on the end portion of the shielded cable W in this order. Subsequently, the connection member 40 is mounted on the shielded cable W in such a manner that the receiving portion 41 is inserted between the insulation layer 12 and the shield layer 13. Then, the opposite side pieces 42A of the fastening portion 42 are substantially fastened to the shield layer 13 and/or insulation sheath 14. As a result, the shield layer 13 is tightly held between the receiving portion 41 and the fastening portion 42, electrically connecting the shield layer 13 and the connection member 40 (see FIG. 2).

Thereafter, the core 11 projecting from the receiving portion 41 is substantially accommodated in and fastened to the core barrel 61 of the male terminal fitting 60, and the metal shell 30 is substantially fitted from the leading end of the male terminal fitting 60 to be mounted on the connection member 40. Then, the metal shell 30 is moved onto the outer surface of the contact portion 43 by being guided by the slanting guide surface 45, thereby deforming the opposite side pieces 43A of the contact portion 43 inwardly to be pressed against the inner surface of the metal shell 30 (see FIGS. 3 and 4). As a result, the connection member 40 and the metal shell 30 are electrically connected and, thus, the shield layer 13 and the metal shell 30 are electrically connected via the connection member 40.

Thereafter, the male terminal fitting 60 connected with the end portion of the shielded cable W is inserted or fitted into the cavity 22 through the assembling opening 22A of the housing 20. More particularly, the male terminal fitting 60 is inserted into the narrow tube 23 and is assembled such that the leading end thereof projects into the receptacle 21. Further, the metal shell 30 is fitted on the narrow tube 23 and pushed forwardly in such a manner that the support arms 28 are engaged with the slots 31. The rubber plug 25 and the rubber plug pressing lid 26 already mounted on the shielded cable W are moved into the rubber plug receptacle 24 and the rubber plug 25 is pressed by the rubber plug pressing lid 26 (see FIG. 5). In this way, the assembling of the connector M is completed.

In this embodiment constructed as above, since the shield layer 13 can be held between the receiving portion 41 and the fastening portion 42, even if the insulation layer 12 is likely to be deformed due to a reduced rigidity, the shield layer 13 and the connection member 40 can be held in contact with each other. As a result, an electrical connection between the shield layer 13 and the metal shell 30 can be securely held. Further, since the receiving portion 41, the fastening portion 42 and the contact portion 43 are integrally or unitarily formed, it is not necessary to provide a plurality of parts, which is advantageous in terms of an economic aspect including costs for molds, parts management and the like.

Figure 7:
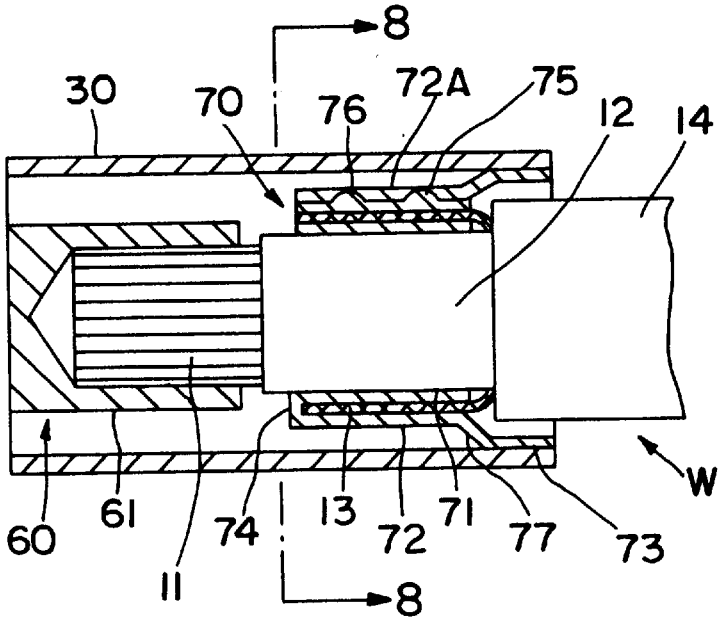
FIG. 7 is a side view in section of the second embodiment after a metal shell is mounted.
Figure 8:
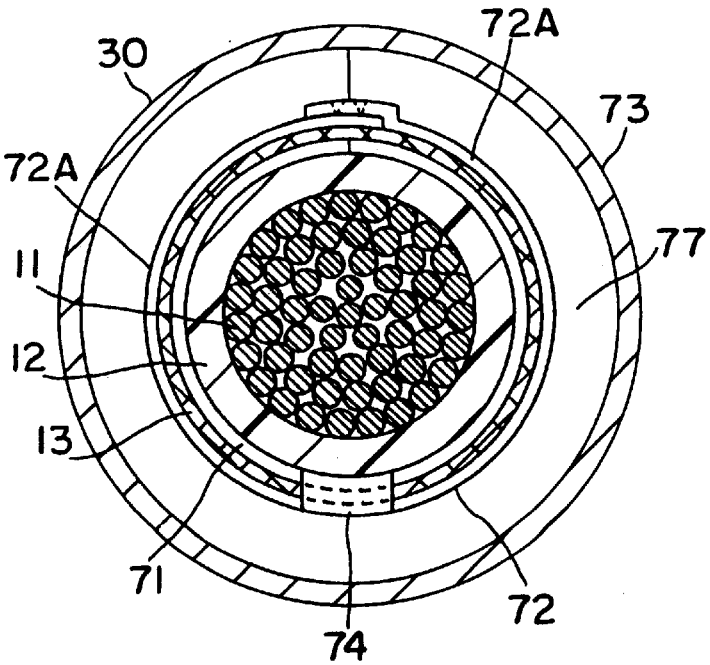
FIG. 8 is a section of the second embodiment along B—B of FIG. 7.

Hereafter, a second embodiment of the shield connector according to the invention is described with reference to FIGS. 6 to 8.

The second embodiment differs from the first embodiment in the construction of a connection member 70. In the first embodiment, the shield layer 13 is forcibly fastened to the receiving portion 41 by the fastening portion 42. However, in the second embodiment, the shield layer 13 is pressed against a receiving portion 71 by a pressing portion 72. Since the other construction is similar to the first embodiment, no description is given thereon by identifying the same elements by the same reference numerals.

Figure 6:
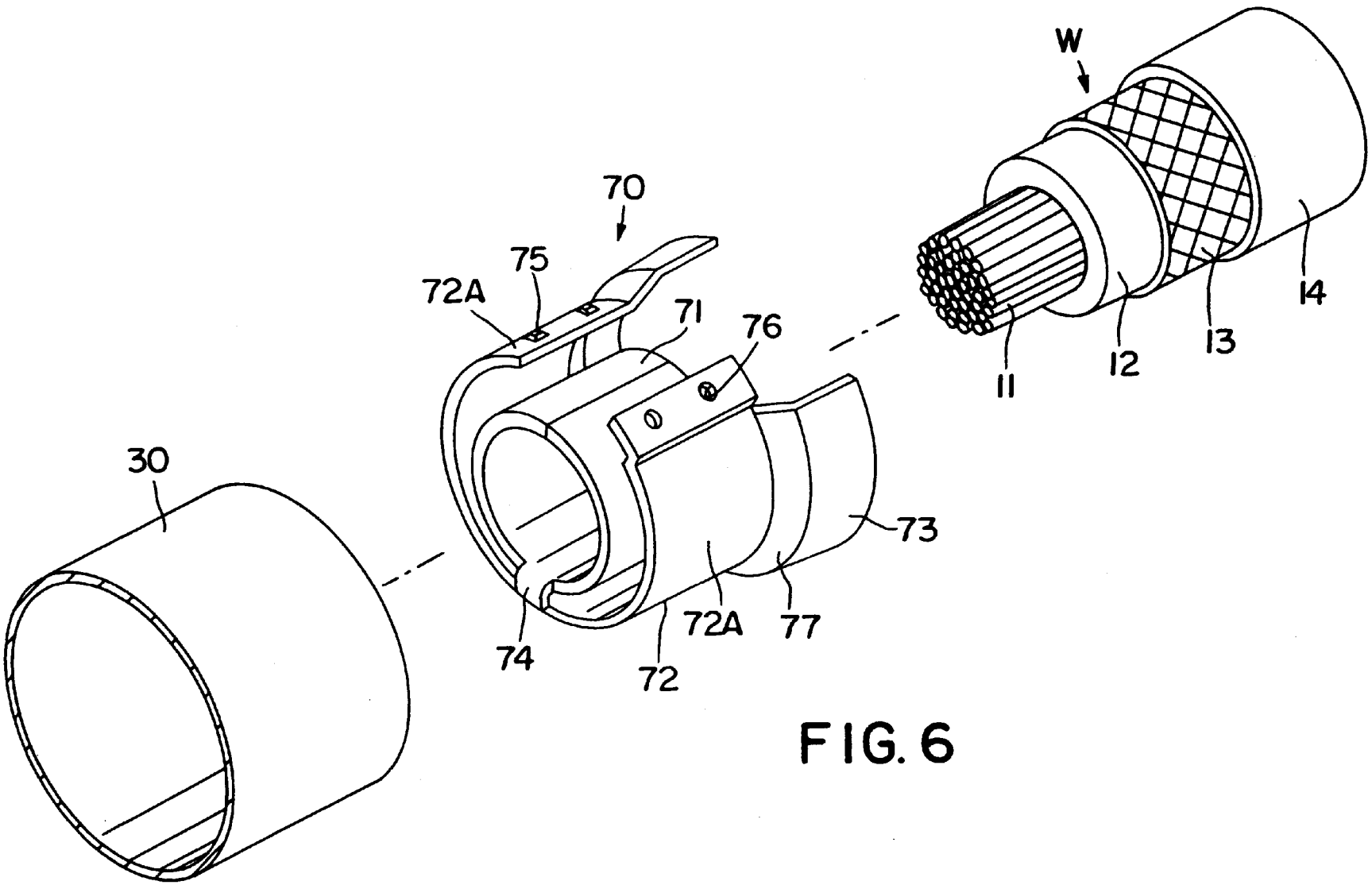
FIG. 6 is a perspective view of a shielded cable, a connection member and other elements of a second embodiment.

As shown in FIG. 6, the pressing portion 72 is provided outside the receiving portion 71 having a preferably tubular shape as in the first embodiment so as to cover it. The pressing portion 72 is integrally or unitarily coupled or connected with the bottom edge of the front end of the receiving portion 71 via a connection or coupling portion 74, with the result that an insertion space for the shield layer 13 is formed between the pressing portion 72 and the receiving portion 71. Further, opposite side pieces of the pressing portion 72 are elastically and/or plastically deformable inwardly, and serve as pressing pieces 72A for pressing the shield layer 13 inserted into the insertion space.

The leading ends of the pressing pieces 72A are formed such that one leading end is placeable on the upper surface of the other leading end. For example, two lock projections 75 (corresponding to the lock portion) are formed side by side at the other leading end, and lock holes 76 (corresponding to engaging portions) are formed in the one leading end in conformity with the respective lock projections 75. The pressing pieces 72A are so held as to press the shield layer 13 by the engagement of the lock projections 75 and the lock holes 76.

A contact portion 73 is so formed as to be substantially continuous with the rear end of the pressing portion 72. This contact portion 73 is formed by projecting the rear edge of the pressing portion 72 outwardly and has a diameter slightly larger than the inner diameter of the metal shell 30. The contact portion 73 is deformed elastically and/or plastically inwardly as the metal shell 30 is inserted to be electrically, and preferably is brought elastically into contact with the inner surface of the metal shell 30. A portion of the connection member 70 continuously extending from the rear edge of the pressing portion 72 to the contact portion 73 is so formed as to extend obliquely outwardly. This portion serves as a slanting guide surface 77 for facilitating the mounting of the metal shell 30 on the contact portion 73.

To electrically connect the shield layer 13 and the metal shell 30, the connection member 70 is mounted on the shielded cable W in such a manner that the receiving portion 71 is inserted under the shield layer 13 as in the first embodiment. Then, the opposite pressing pieces 72A are pressed inwardly to be elastically deformed, and the lock projections 75 are fitted into the lock holes 76. As a result, the shield layer 13 is held tightly between the receiving portion 71 and the pressing portion 72. If the metal shell 30 is mounted after the male terminal fitting 60 is connected as in the first embodiment, the contact portion 73 is deformed slightly to be pressed against the inner surface of the metal shell 30. In this way, the shield layer 13 and the metal shell 30 are connected electrically via the connection member 70 (see FIGS. 7 and 8).

Accordingly, since the shield layer 13 can be held between the receiving portion 71 and the pressing portion 72 in this embodiment as well, this embodiment also has effects similar to those of the first embodiment: e.g., the electrical connection between the shield layer 13 and the metal shell 30 can be securely held despite the reduced rigidity of the insulation layer 12. Further, since the pressing portion 72 is so held as to press the shield layer 13 by the engagement of the lock projection 75 and the lock hole 76 in this embodiment, no fastening operation is necessary unlike the first embodiment, advantageously facilitating the mounting of the connection member 70.

Hereafter, a third embodiment of a shield connector according to the invention is described with reference to FIGS. 9 to 13. This embodiment differs from the preceding embodiments in particular in the connection member 140.

Parts or elements being similar or the same as the preceding embodiments are denoted with the same reference numerals. Accordingly a detailed description thereof is omitted hereinafter.

Figure 9:
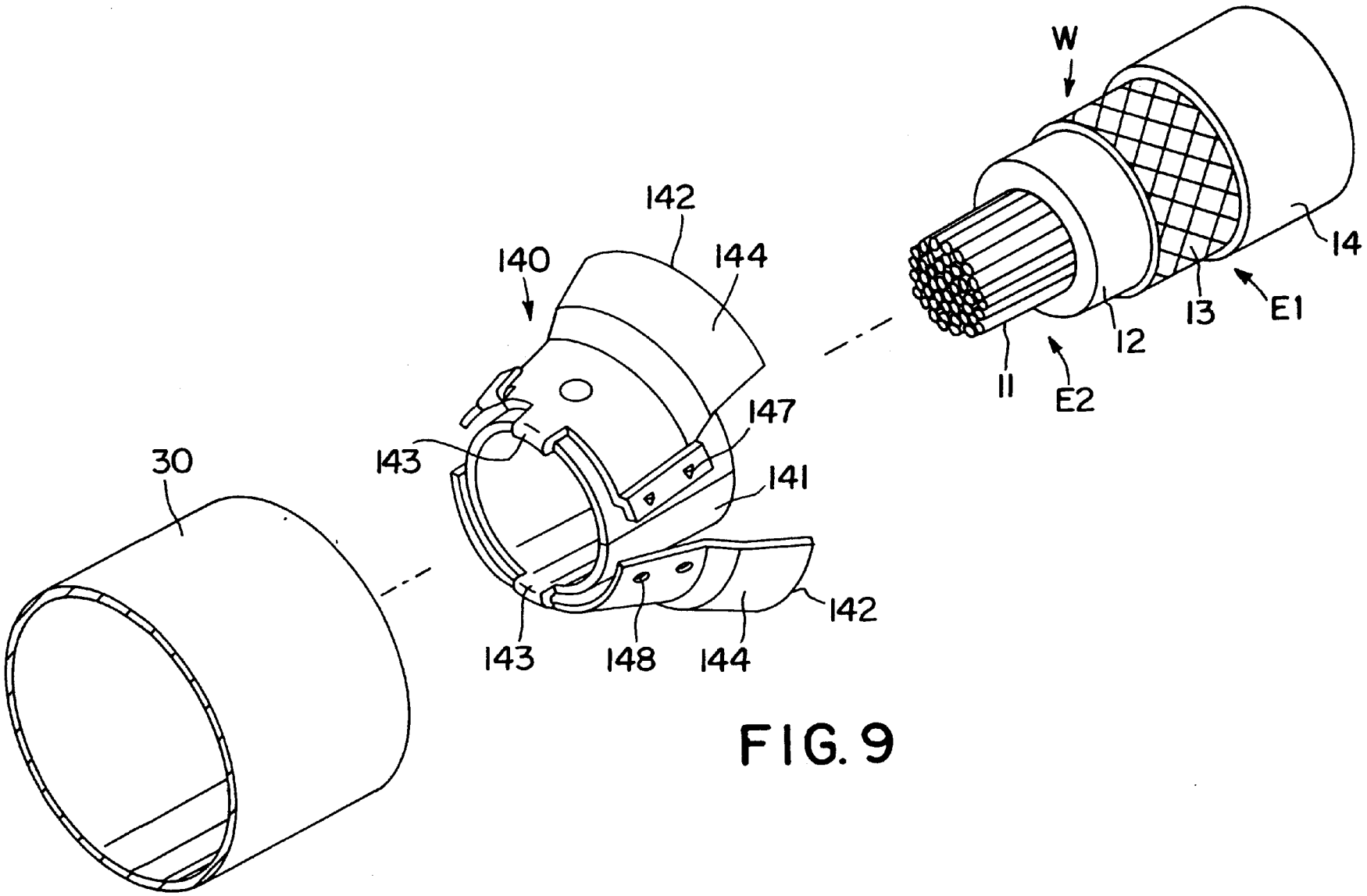
FIG. 9 is a perspective view of a shielded cable, a connection member and other elements of a third embodiment.

As shown in FIG. 9, the connection member 140 is formed e.g. by bending a conductive metal plate and is comprised of a receiving portion 141 (corresponding to the receiving member) to be inserted substantially under the shield layer 13, and pressing pieces 142 (corresponding to the pressing members) for pressing the shield layer 13 substantially against the receiving portion 141.

The receiving portion 141 has preferably a tubular shape corresponding to the shape of the wire W and its outer diameter is substantially equal to the inner diameter of the shield layer 13. Further, the length of the receiving portion 141 preferably is set substantially equal to the length of the exposed shield layer 13.

The pressing pieces 142 are so formed as to have an arcuate shape extending along the outer surface of the receiving portion 141 and opposed along vertical direction with the receiving portion 141 therebetween. The leading ends of the pressing pieces 142 are connected integrally with the leading edge of the receiving portion 141 via coupling portions 143. A rear end portion of each pressing piece 142 is curved slightly outwardly to form a contact portion 144 with the metal shell 30. The pressing pieces 142 are opened backwardly in their normal states (state of FIG. 10). When the metal shell 30 is mounted, the rear end portions of the pressing portions 142 are pressed substantially inwardly (directions of arrow in FIG. 10), thereby elastically being deformed substantially inwardly about the coupling portions 143.

Figure 10:
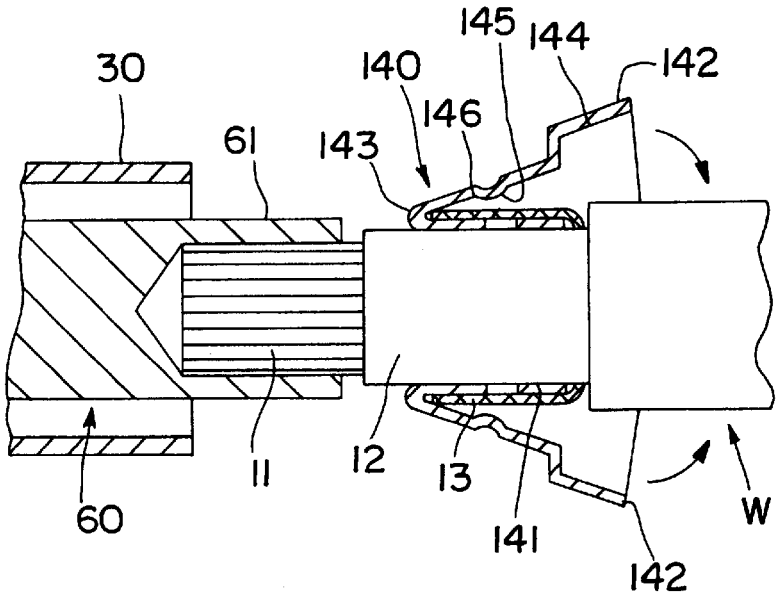
FIG. 10 is a side view in section of the third embodiment before a metal shell is mounted.

The inner surfaces of base portions of the pressing pieces 142 preferably are embossed, as shown in FIG. 10, to form engaging projections 145, and the receiving portion 141 facing the pressing pieces 142 is formed with engaging recesses 146 that engageable with the engaging projections 145. In the deformed states of the pressing pieces 142, the left and right ends of the lower pressing piece 142 are placed on the left and right ends of the upper pressing piece 142. Two lock projections 147 (corresponding to the lock portion) are formed on each of the left and right ends of the upper pressing pieces 142, and two lock holes 148 (corresponding to the engaging portion) are formed on each of the left and right ends of the lower pressing piece 142 so as to conform or mate to the lock projections 147. The pressing pieces 142 preferably are held releasably and are deformed by the engagement of the lock projections 147 and the lock holes 148.

Next, the assembling of the connector is described. In order to assemble the connector, the male terminal fitting 60, the metal shell 30 and the like are mounted on the end portion of the shielded cable W. First, the rubber plug pressing lid 26 and the rubber plug 25 are fitted on the end portion of the shielded cable W in this order. Subsequently, the connection member 140 is mounted substantially on the shielded cable W in such a manner that the receiving portion 141 is inserted substantially between the insulation layer 12 and the shield layer 13. Then, the receiving portion 141 is fitted or inserted into the metal shell 30 to substantially accommodate the projecting core 11 in the core barrel 61 of the male terminal fitting 60 and the core barrel 61 is fastened forcibly (see FIG. 10).

Figure 11:
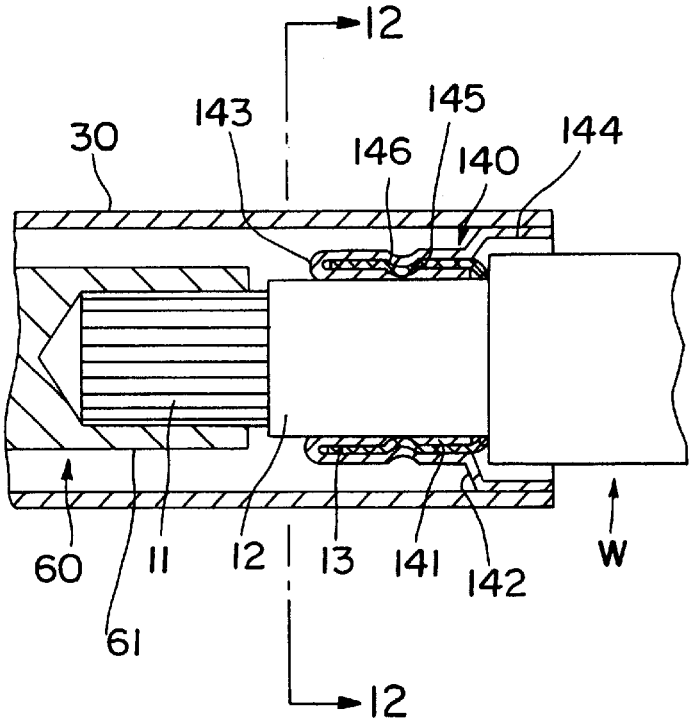
FIG. 11 is a side view in section of the third embodiment after the metal shell is mounted.
Figure 12:
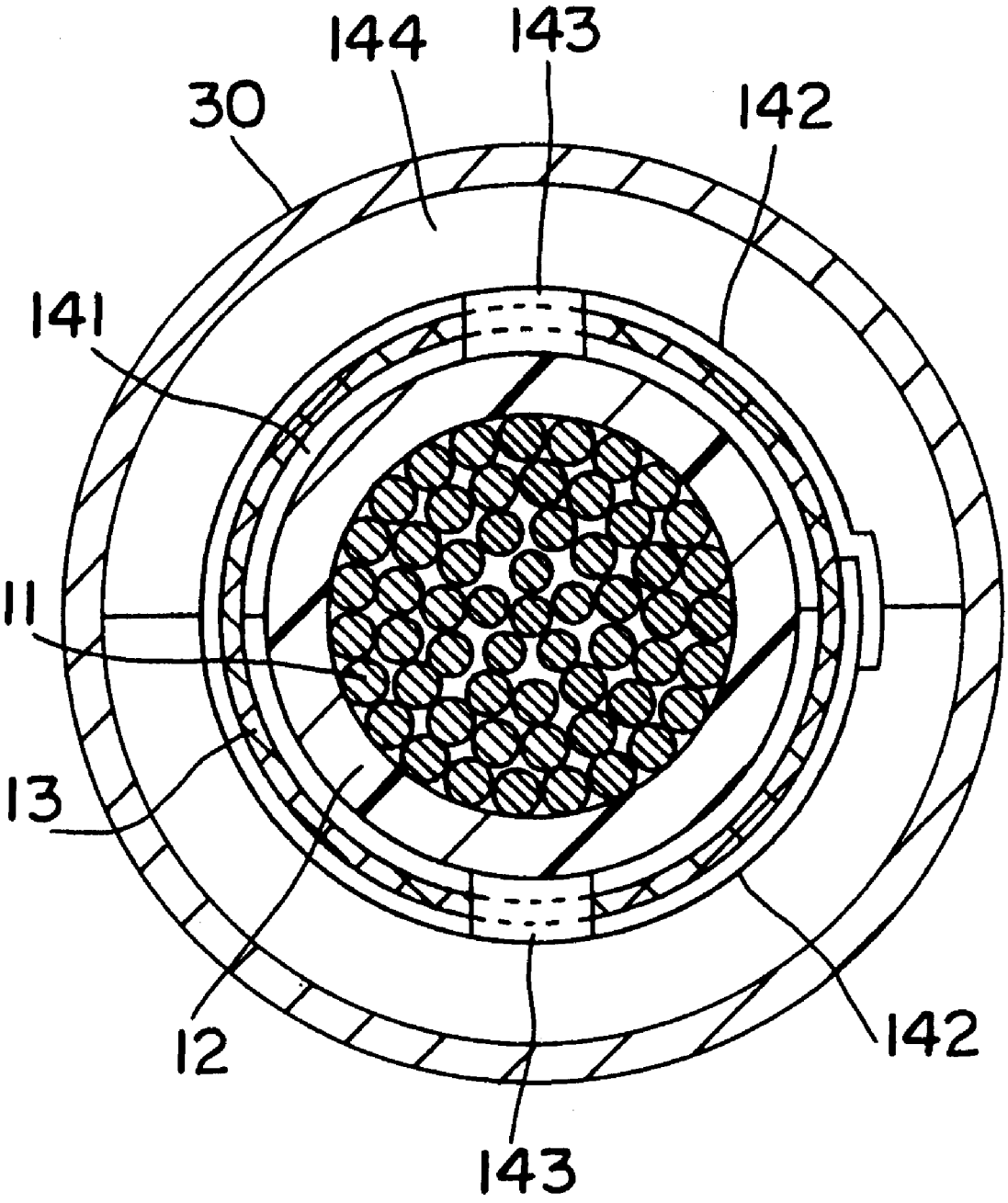
FIG. 12 is a section of the third embodiment along A—A of FIG. 11.
Figure 13:
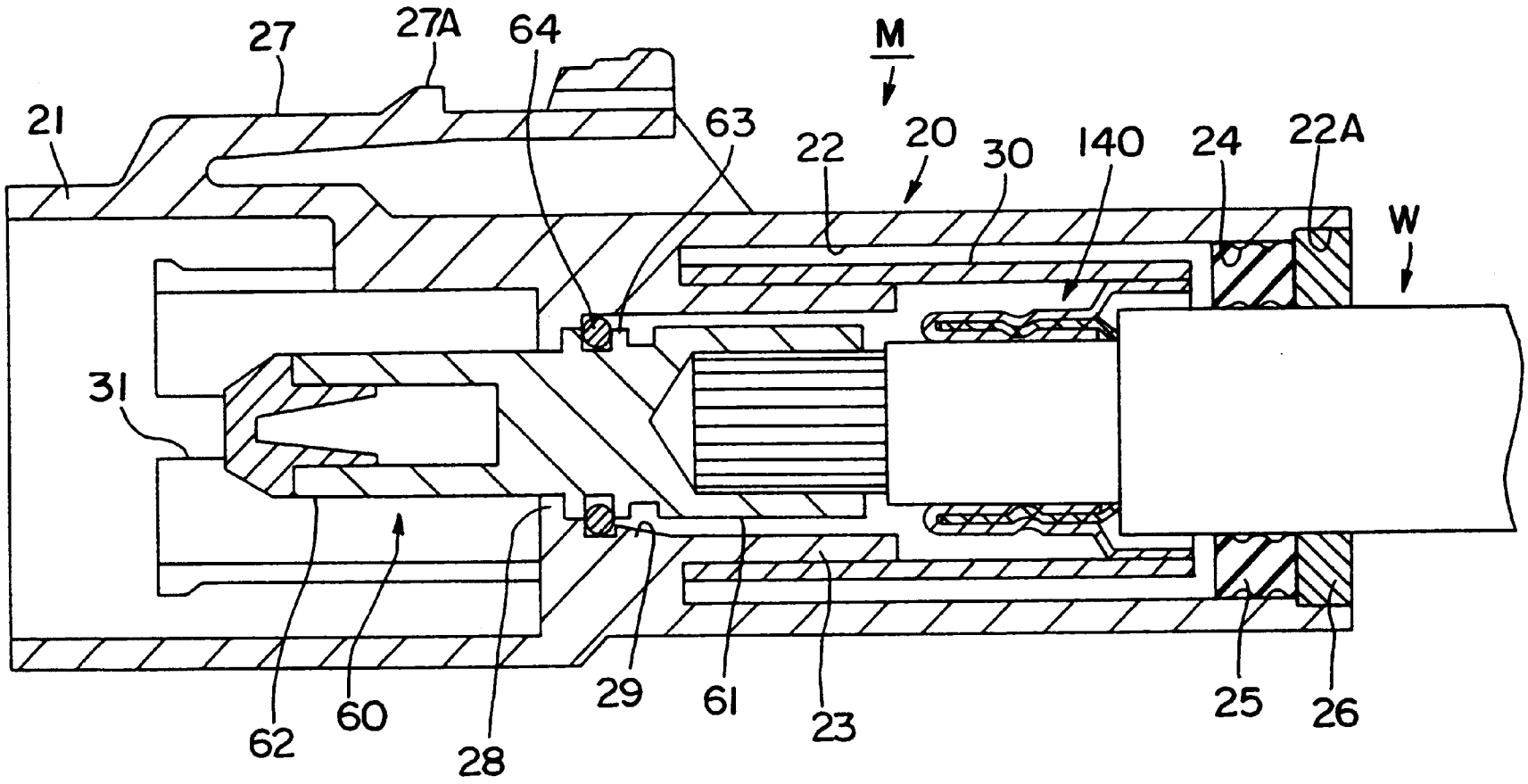
FIG. 13 is a side view in section entirely showing a shield connector according to the third embodiment.

When the fastening of the male terminal fitting 60 is completed, the metal shell 30 is fitted from the leading end of the male terminal fitting 60 (FIG. 10) to be mounted on the connection member 140 (FIG. 11). As the metal shell 30 is fitted, the respective pressing pieces 142 are pressed inwardly, thereby being deformed elastically inwardly about the coupling portion 143. Thereby, the shield layer 13 is pressed strongly against the receiving portion 141 by the base portions of the respective pressing pieces 142 (see FIG. 12). At this time, the engaging projection 145 and the engaging recess 146 are engaged and the shield layer 13 is caught substantially between them.

In other words, the shield layer 13 is pressed against the receiving portion 141 by the action of lever with the coupling portion 143 as a fulcrum and the contact portion 144 as a point of action.

Thereafter, the male terminal fitting 60 and the like which are connected with the end portion of the shielded cable W are inserted into the cavity 22 through the assembling opening 22A of the housing 20. At this time, the male terminal fitting 60 is inserted into the narrow tube 23 and is assembled such that the leading end thereof projects into the receptacle 21. Further, the metal shell 30 is fitted on the narrow tube 23 and is pushed forwardly in such a manner that the support arms 28 are engaged with the slots 31. The rubber plug 25 and the rubber plug pressing lid 26, already mounted on the shielded cable W, are moved into the rubber plug receptacle 24 and the rubber plug 25 is pressed by the rubber plug pressing lid 26 (see FIG. 13). In this way, the assembling of the connector M is completed.

The third embodiment thus constructed has the following effects.

Since the shield layer 13 can be held between the receiving portion 141 and the pressing pieces 142, the shield layer 13 and the connection member 140 can be held in contact with each other even if the insulation layer 12 becomes likely to be deformed due to its reduced rigidity. Further, since the shield layer 13 can be pressed against the receiving portion 141 taking advantage of the action of lever, the pressing operation can be performed easily.

Since the base portions of the pressing pieces 142 and the portions of the receiving portion 141 facing them are formed with the engaging projections 145 and the engaging recesses 146 which are engageable with each other, when the shield layer 13 is pressed against the receiving portion 141, the shield layer 13 is caught between the engaging projections 145 and the engaging recesses 146. As a result, the contact of the shield layer 13 and the connection member 140 can be more secured.

By providing the lock projections 147 and the lock holes 148, the pressing pieces 142 are held while being pressed. Accordingly, the pressing pieces 142 are not restored inadvertently to their original positions after pressing the shield layer 13, with the result that the shield layer 13 and the pressing pieces 142 are held more securely in contact with each other.

Since the pressing pieces 142 and the receiving portion 141 are formed integrally or unitarily, the number of parts can be reduced, which is advantageous in terms of an economic aspect including costs for molds, parts management and the like.

Figure 15:
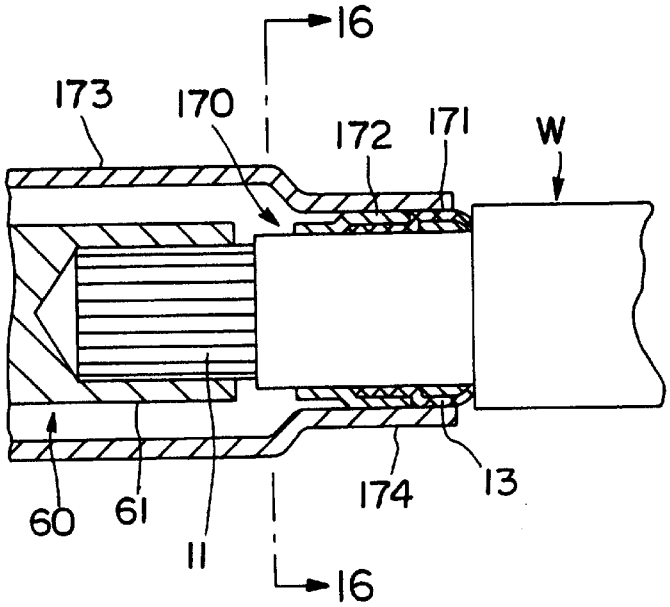
FIG. 15 is a side view in section of the fourth embodiment after a metal shell is mounted.
Figure 16:
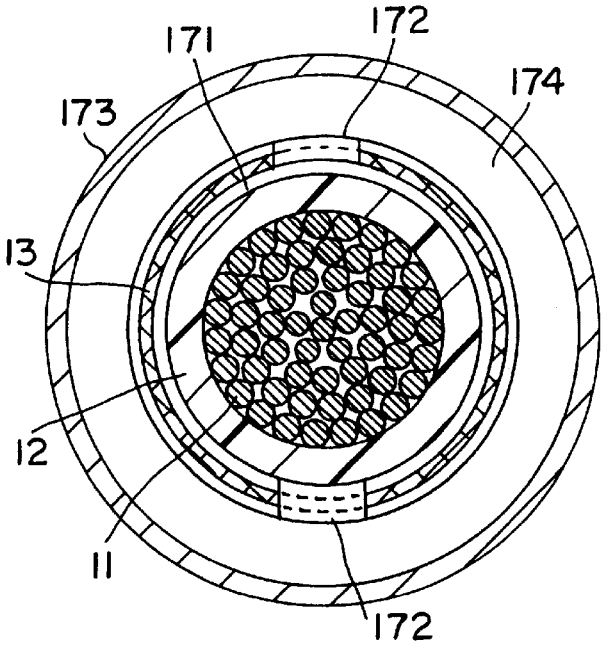
FIG. 16 is a section of the fourth embodiment along B—B of FIG. 15.

Hereafter, a fourth embodiment of the shield connector according to the invention is described with reference to FIGS. 14 to 16.

In this embodiment, a connection member 170 is constructed e.g. by making cuts in a receiving portion 171 to form pressing pieces 172 and bending these cut portions outwardly.

Figure 14:
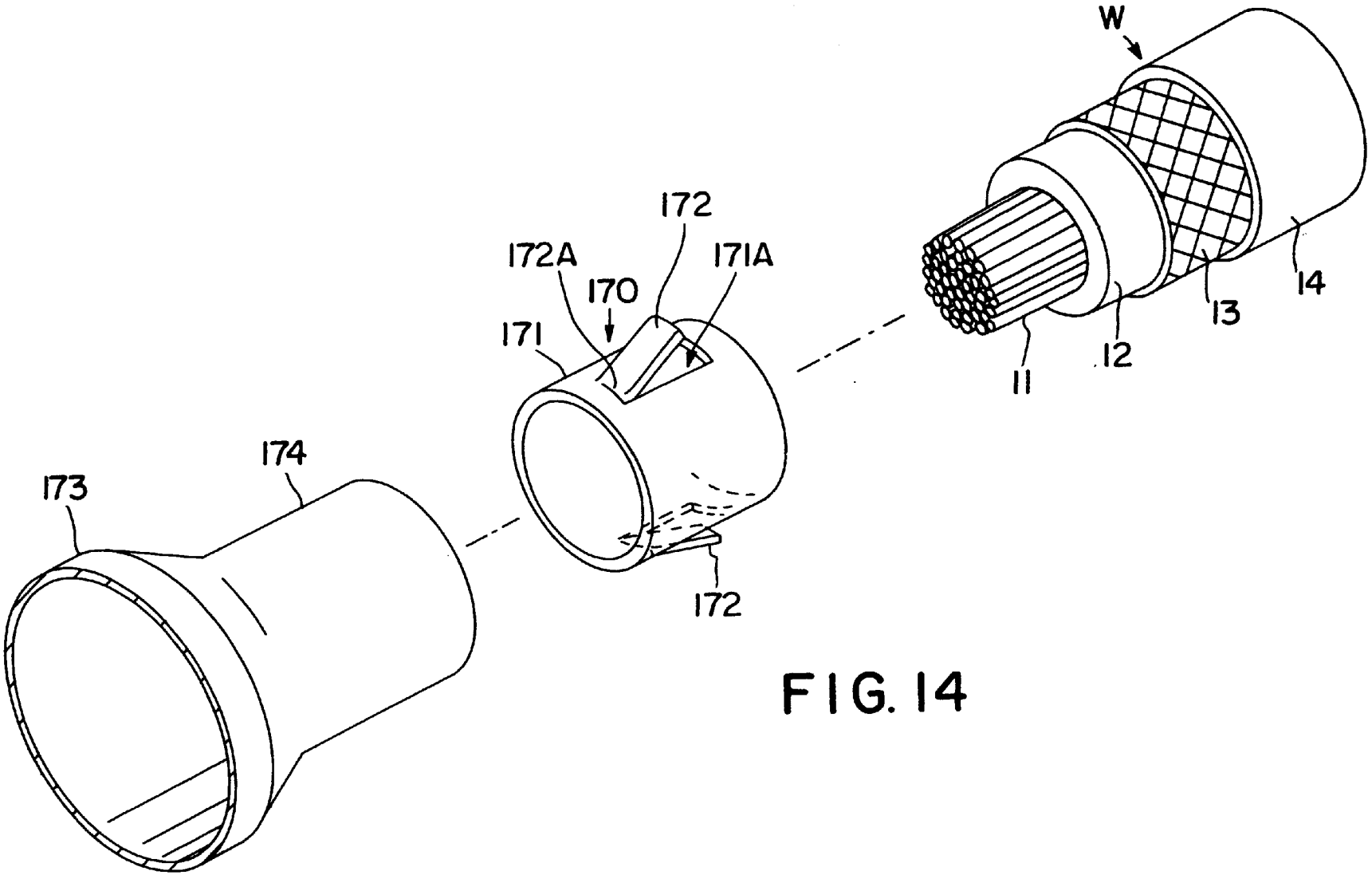
FIG. 14 is a perspective view of a shielded cable, a connection member and other elements of a fourth embodiment.

Specifically, as shown in FIG. 14, the receiving portion 171 is formed to have a substantially tubular shape as in the third embodiment. The pressing pieces 172 are bent outward to obliquely extend backward at upper and lower parts of the receiving portion 171.

A rear end portion of the metal shell 173 is narrowed, and the diameter of this narrow portion 174 is slightly larger than the diameter of the receiving portion 171 and slightly smaller than a spacing between the rear ends of the pressing pieces 172 in a state where no force is applied. Since the other construction is similar to that of the third embodiment, no description is given thereon by identifying it by the same reference numerals.

To electrically connect the shield layer 13 and the metal shell 173, the receiving portion 171 is inserted under the shield layer 13 as in the third embodiment. At this time, the receiving portion 171 is inserted until the leading end of the shield layer 13 comes into contact with the base portions 172A of the pressing pieces 172. When the metal shell 173 is fitted, the rear ends of the pressing pieces 172 are pressed inwardly as the metal shell 173 is moved toward the cable W, with the result that the pressing pieces 172 are deformed about their base portions 172A. Accordingly, the pressing pieces 172 are pressed into the narrow portion 174 of the metal shell 173 and, at the same time, the shield layer 13 is pressed by means of the pressing pieces 172 into the openings 171A left after the pressing pieces 172 are bent outwardly at or by the base portions of the pressing pieces 172 (see FIGS. 15 and 16). Thus, the shield layer 13 and the metal shell 173 are connected electrically via the connection member 170.

Since the shield layer 13 can be held between the receiving portion 171 and the pressing pieces 172 in this embodiment as well, the shield layer 13 and the metal shell 173 can be held securely electrically connected despite a reduced rigidity of the insulation layer 12 similar to the third embodiment. Further, in this embodiment, since the connection member 170 is formed by bending the pressing pieces 172 outwardly with respect to the tubular receiving portion 171, it can be simply formed.

Figure 17:
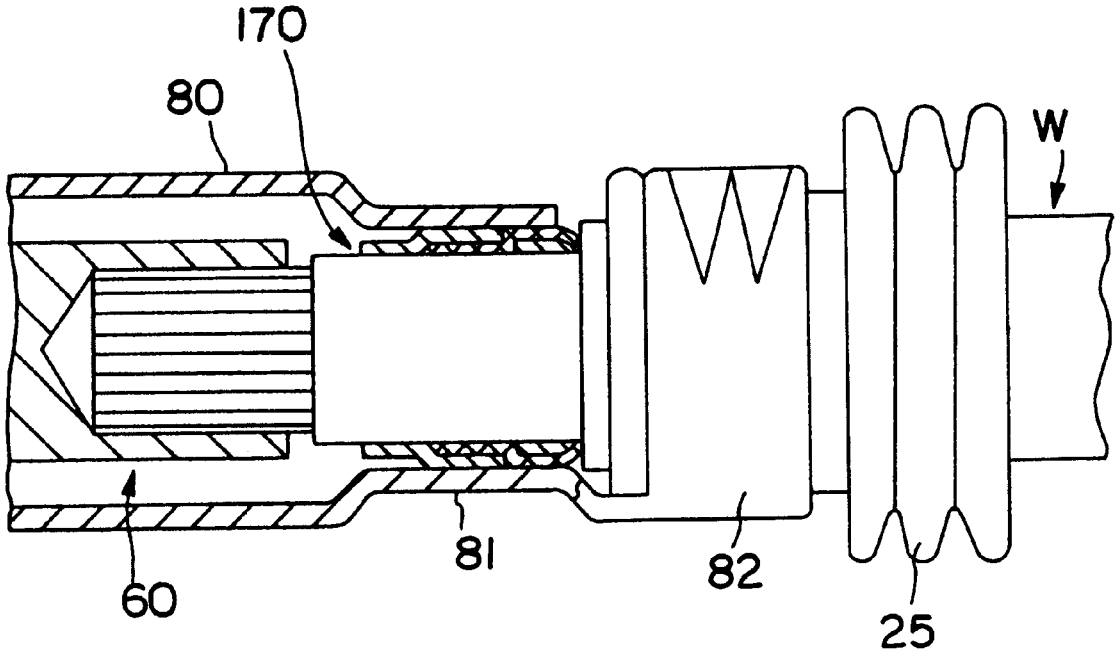
FIG. 17 is a side view in section showing a metal shell and other elements of a fifth embodiment.

Although the rubber plug 25 is accommodated in the rubber plug accommodating portion 24 and pressed by the rubber plug pressing lid 26 in the third embodiment, the shield connector may be constructed as shown in FIG. 17.

Specifically, a rear end portion of a metal shell 80 is narrowed to form a narrow portion 81 as in the fourth embodiment, and the narrow portion 82 is further extended backwardly to form a sealing member or rubber plug fastening portion 82. Since the other construction is similar to that of the fourth embodiment, no description is given thereon by identifying it by the same reference numerals.

In this construction, the rubber plug 25 is fastened securely to the rubber plug fastening portion 82 at the rear end of the metal shell 80. Since the rubber plug 25 is accommodated in the rubber plug accommodating portion 24 (see FIG. 13), it does not come out of the accommodating portion 24 even if, unlike the third embodiment, the rubber plug pressing lid 26 is not provided. Accordingly, the number of the parts can be reduced since no pressing lid 26 is provided.

Hereafter, a fourth embodiment of a shield connector according to the invention is described with reference to FIGS. 18 to 23.

Figure 23:
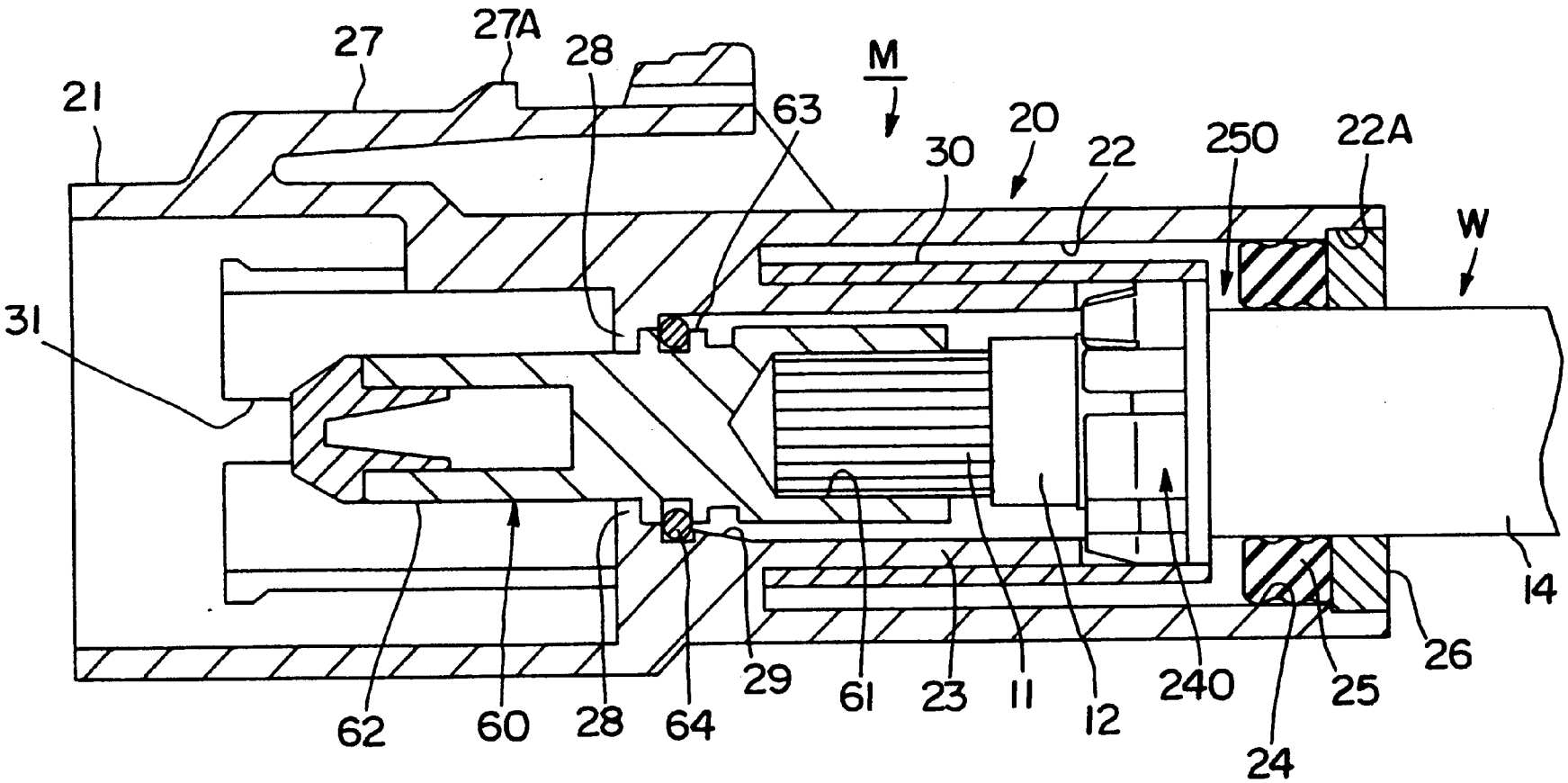
FIG. 23 is a side view in section of shield connector.
Figure 24:
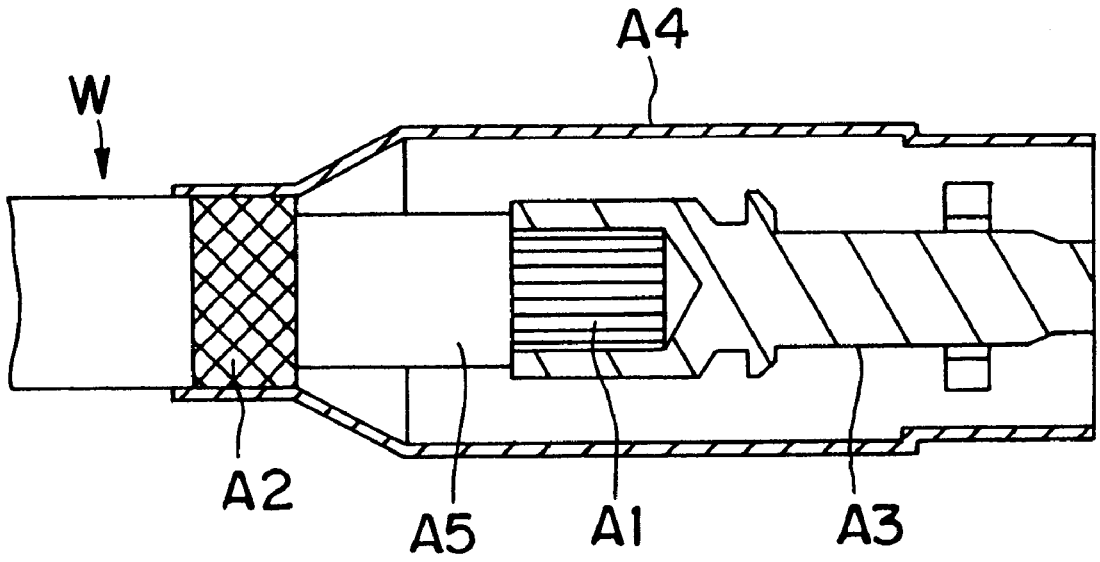
FIG. 24 PRIOR ART
FIG. 24 is a side view in section of a prior art shield connector in which a metal shell is forcibly fastened.
Figure 25:
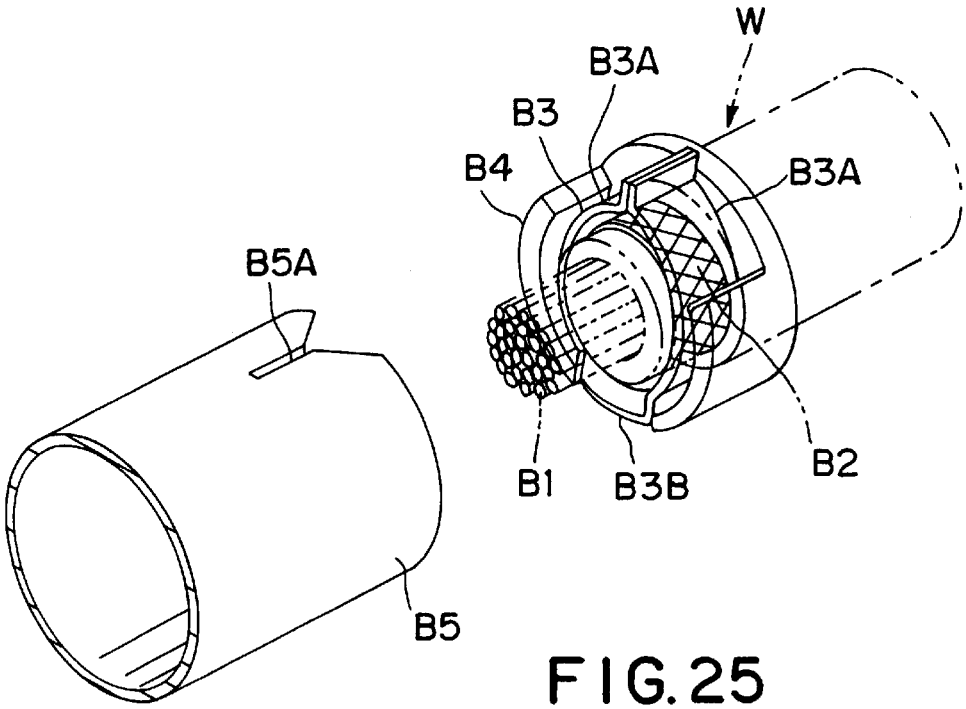
FIG. 25 PRIOR ART
FIG. 25 is a perspective view of a prior art shield connector.
Figure 26:
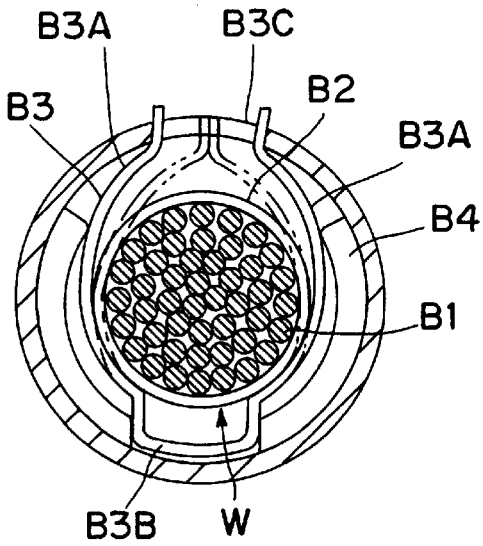
FIG. 26 PRIOR ART
FIG. 26 is a front view in section of the prior art shield connector.

FIG. 23 is a section entirely showing the fourth embodiment. As shown, a shield connector M according to this embodiment is a male connector and an end of a shielded cable W is connected with this shield connector M.

Parts or elements being similar or the same as the preceding embodiments are denoted with the same reference numerals. Accordingly a detailed description thereof is omitted hereinafter.

Figure 22:
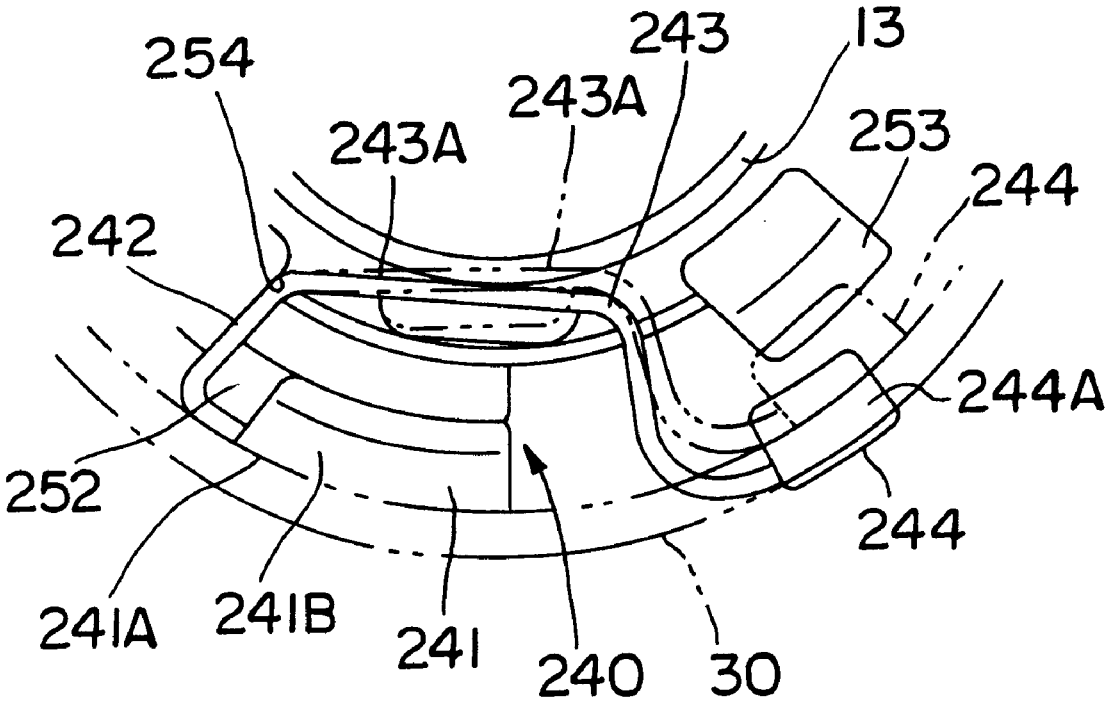
FIG. 22 is an enlarged front view showing the movement of a contact pressure assisting portion.

The shield connector M is, as shown in FIG. 22, comprised of a housing 20, a metal shell 30 (corresponding to the shield tube according to the invention), and a holder 250 provided with a plurality of connection pieces 240 and the like.

Further, as shown in FIG. 23, a holder 250 provided with a plurality of connection pieces 240 for electrically connecting the metal shell 30 and the shield layer 13 of the shielded cable W is accommodated in the cavity 22. Herebelow, the holder 250 and the respective connection pieces 240 are described.

Figure 18:
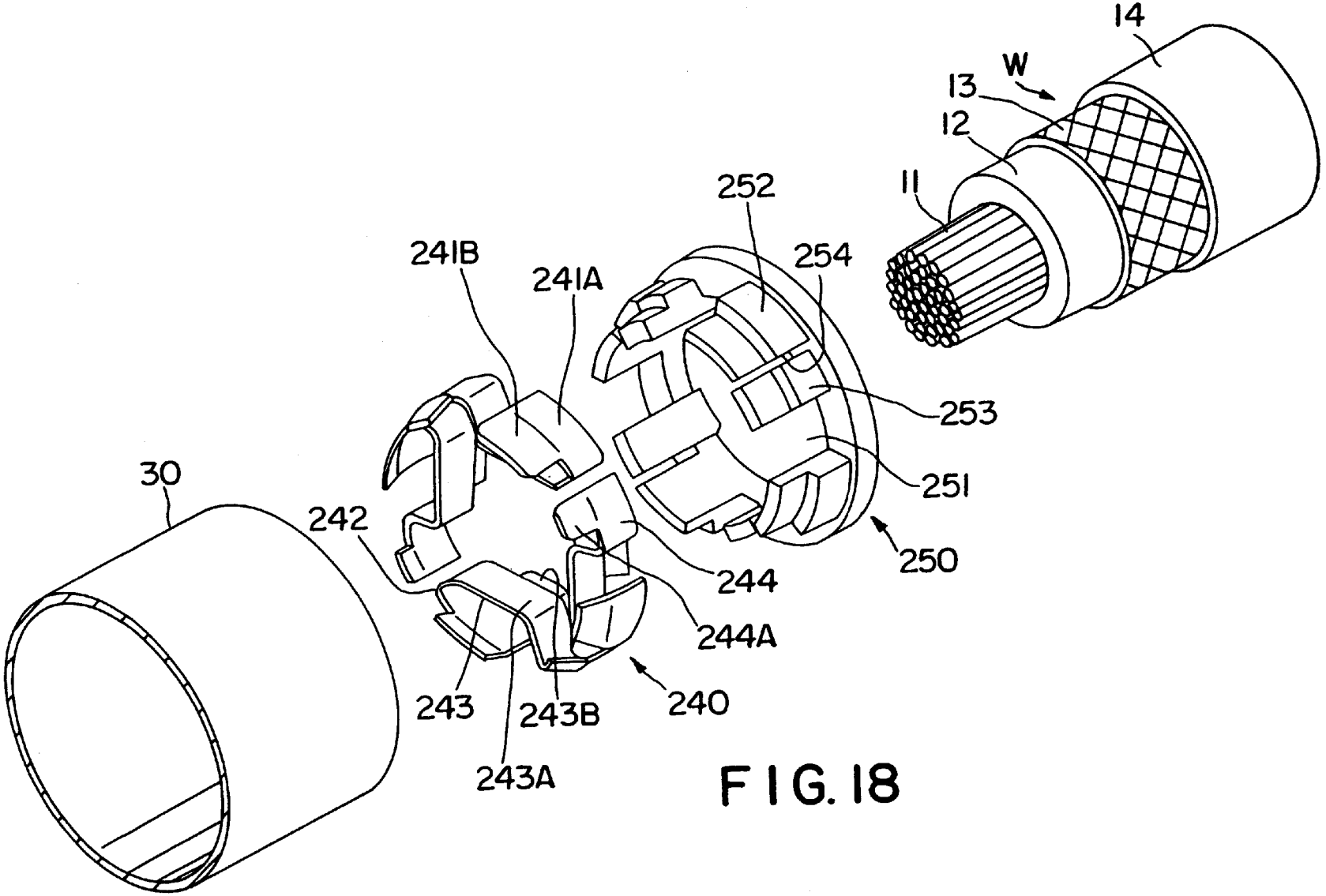
FIG. 18 is a perspective view showing a holder, a terminal member and other elements of a sixth embodiment of the invention.

The holder 250 is made e.g. of a synthetic resin material having an electrically insulating property. This holder 250 is, as shown in FIG. 18, formed with an insertion hole 251 for introducing the end of the shielded cable W. The size of the insertion hole 251 is set substantially equal to the outer diameter of the shielded cable W.

Figure 19:
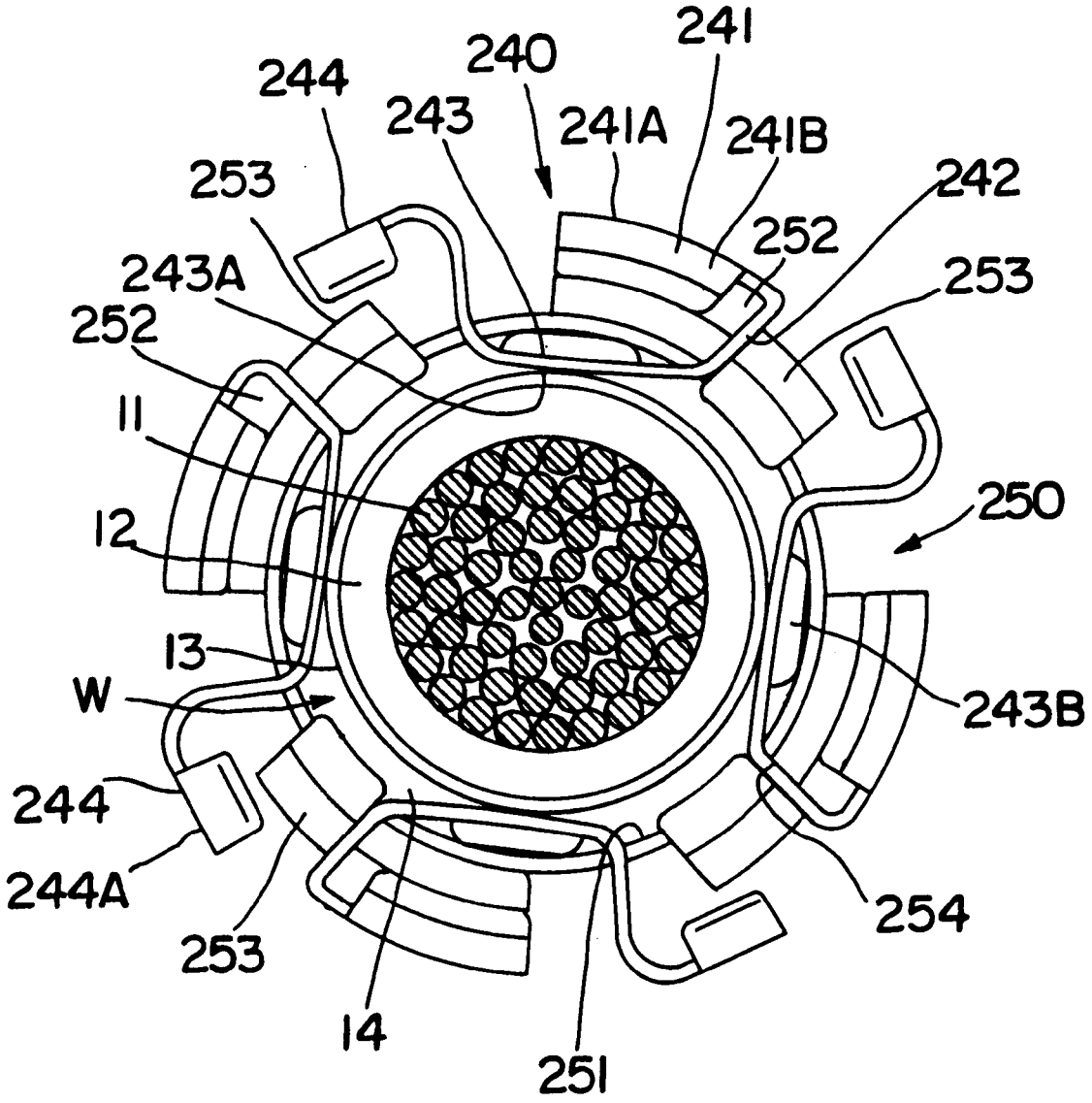
FIG. 19 is a front view of the holder when being mounted on an end of a shielded cable.
Figure 20:
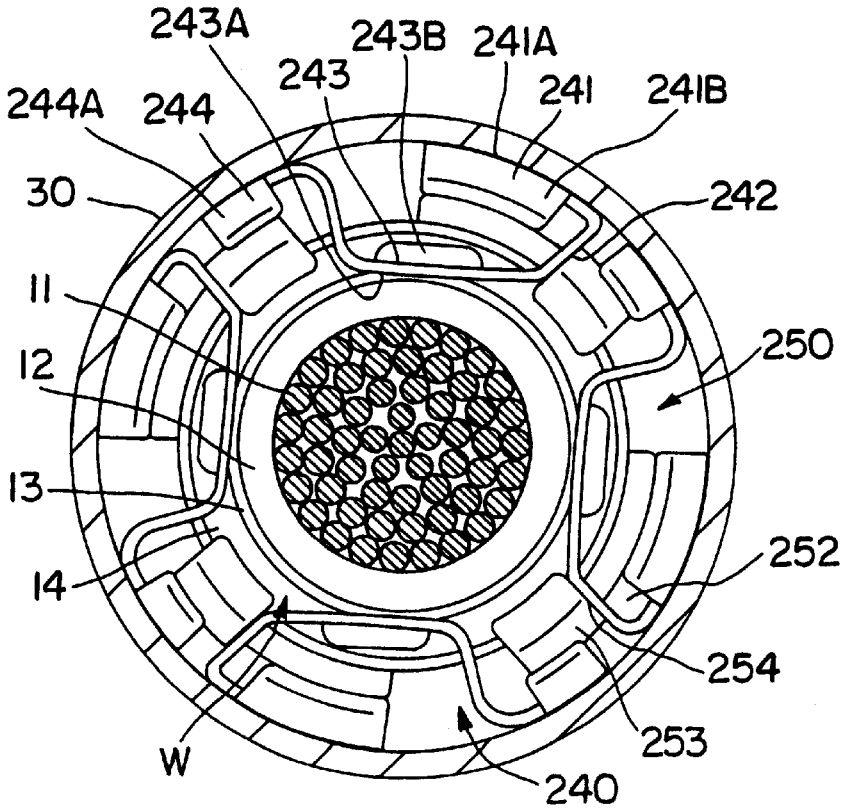
FIG. 20 is a front view in section when a metal shell is mounted.

On a front surface of the holder 250 (right surface in FIG. 18), e.g. four pairs of the support projections 252, 253 are formed at preferably substantially equal intervals on the periphery of the insertion hole 251. Between the corresponding pairs of the support projections 252 and 253 are defined narrow clearances, which serve as press slots 254 into which holding portions 242 of the respective connection pieces 240 to be described later are to be pressed. The upper projecting portions, preferably halves of the outer surfaces of the support projections 252, 253 are thinned. As shown in FIG. 19, the support projections 253 are arranged slightly radially more inwardly than the support projections 252, and the inner side surfaces thereof slightly project into the insertion hole 251. Accordingly, when the end of the shielded cable W is inserted into the insertion hole 251, the rear edges of the projecting portions of the support projections 253 (edges at the rear surface side in FIG. 19) come into contact with the leading edge of the sheath 14, thereby preventing the sheath 14 from being inserted into the insertion hole 251.

Each connection piece 240 is formed e.g. by bending a conductive metal plate, and one end thereof is folded outwardly substantially along the support projection 252 after being pressed into the press slot 254 of the holder 250 as shown in FIG. 19. This folded portion is a metal shell contact portion 241, the outer surface of which is a contact surface 241A for coming into pressing contact with the inner surface of the metal shell 30. A portion of the connection piece 240 to be pressed into the press slot 254 is the holding portion 242. The connection piece 240 is preferably held in the holder 250 by the engagement of the holding portion 242 and the press slot 254.

The other end of the connection piece 240 extends to the adjacent support projection 253, slightly crossing a part of the insertion hole 251 and projects outward of the support projection 253. This portion crossing the insertion hole 251 is a shield layer contact portion 243, the inner surface of which is a contact surface 243A for coming into pressing contact with the shield layer 13. A portion projecting outwardly of the adjacent support projection 253 is a contact pressure assisting portion 244. By pressing the contact pressure assisting portion 244 inward as shown in FIG. 22, the shield layer contact portion 243 can be elastically deformed inward.

Figure 21:
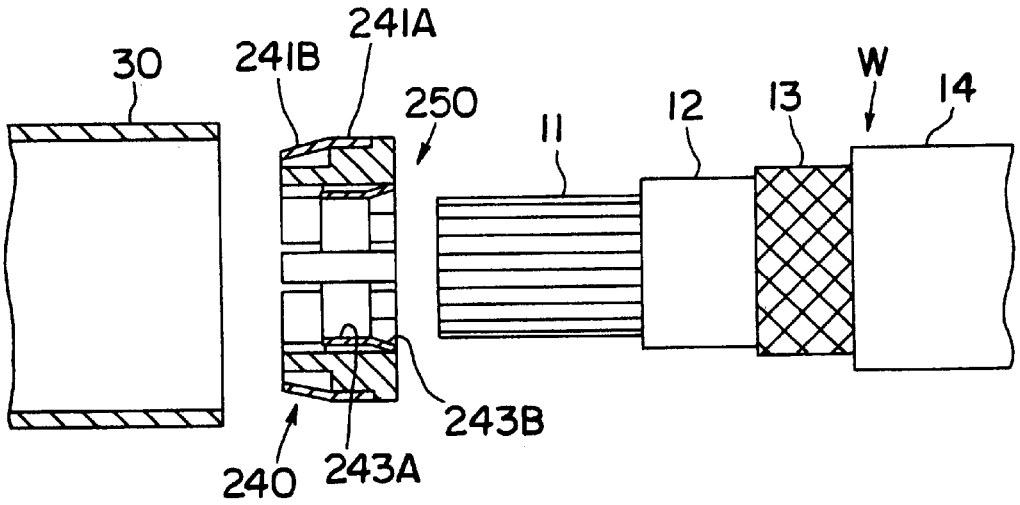
FIG. 21 is a side view in section of the holder assembled with the terminal member.

At the leading ends (front side in FIG. 19) of the metal shell contact portion 241 and the contact pressure assisting portion 244, there are formed guide portions 241B, 244A which are bent obliquely inwardly in order to make it easier to fit the metal shell 30 outside the metal shell contact portion 241 and the contact pressure assisting portion 244. The outer surface of the guide portion is a slanting guide surface 241B for guiding the metal shell 30 (shield tube) to the contact surface 241A. Further, as shown in FIG. 21, a guide portion 243B which is obliquely bent outwardly is formed at the rear end (right end in FIG. 21) of the shield layer contact portion 243 in order to facilitate the insertion of the shield layer 13 into the insertion hole 251. The inner side surface of the guide portion 243B is a slanting guide surface for guiding the shield layer 13 to the contact surface 243A.

Next, the assembling of the connector is described. To assemble the connector, the male terminal fitting 60, the metal shell 30 and the like are mounted in the cavity 22 while being connected with the end portion of the shield cable W. Accordingly, the male terminal fitting 60, the metal shell 30 and the like need to be mounted on the end portion of the shielded cable W in advance.

First, the rubber plug pressing lid 26 and the rubber plug 25 are mounted on the end of the shielded cable W in this order. Subsequently, the holder 250 in which the respective connection pieces 240 are assembled in their specified positions is mounted on the shielded cable W. Then, the exposed core 11 and insulation layer 12 are inserted into the insertion hole 251 in this order. In other words, the core 11 and the insulation layer 12 are inserted in a space enclosed by the shield layer contact portions 243 of the connection pieces 240. Further, the shield layer 13 is pressed into the space enclosed by the shield layer contact portions 243 while being guided by the guide portion 243B, with the result that the contact surfaces 243A are brought into pressing contact with the shield layer 13 to electrically connect the shield layer 13 and the connection pieces 240. By bringing the contact surfaces 243A into pressing contact with the shield layer 13, the holder 250 becomes unlikely to rotate with respect to the shielded cable W (see FIG. 19).

When the rear edges of the support projections 253 of the holder 250 come into contact with the edge of the sheath 14, any further insertion of the shielded cable W into the holder 250 is prevented. In this way, the mounting of the holder 250 is substantially completed.

Subsequently, the male terminal fitting 60 is forcibly fastened to the core 11. This is done by accommodating the core 11 inserted into the holder 250 in the core barrel 61 of the male terminal fitting 60 and forcibly fastening the core barrel 61.

The metal shell 30 is fitted from the leading end of the fastened male terminal fitting 60. The metal shell 30 is fitted outside the holder 250 while being moved backwardly. At this time, the metal shell 30 is guided to a position outside the metal shell contact portions 241 and the contact pressure assisting portions 244 by the guide portions 241B, 244A. In this way, the contact surfaces 241A of the metal shell contact portions 241 are brought into pressing contact with the inner surface of the metal shell 30 (see FIG. 20). Accordingly, the shield layer 13 and the metal shell 30 are electrically connected via the connection pieces 240. As the metal shell 30 is mounted, the contact pressure assisting portions 244 are pressed by the inner surface of the metal shell 30, thereby being elastically deformed inwardly as shown in FIG. 22 to strongly press the shield layer contact portion 243 against the shield layer 13 (see a portion indicated by phantom line in FIG. 22). As a result, a contact of the contact surfaces 243A of the shield layer contact portions 243 and the shield layer 13 can be more secure.

Thereafter, the male terminal fitting 60 and the like which are connected with the end portion of the shielded cable W are inserted into the cavity 22 through the assembling opening 22A of the housing 20. At this time, the male terminal fitting 60 is inserted into the narrow tube 23 and is assembled such that the leading end thereof projects into the receptacle 21. Further, the metal shell 30 is fitted on the narrow tube 23 and pushed forward in such a manner that the support arms 28 are engaged with the slots 31. The rubber plug 25 and the rubber plug pressing lid 26 already mounted on the shielded cable W are moved into the rubber plug receptacle 24 and the rubber plug 25 is pressed by the rubber plug pressing lid 26 (see FIG. 23). In this way, the assembling of the connector M is substantially completed.

As described above, in this embodiment, the respective connection pieces 240 and the shield layer 13 are electrically connected before the metal shell 30 is mounted. Accordingly, it is not necessary to provide a fastening slot in the metal shell unlike the prior art and there is no restriction with respect to the insertion direction of the metal shell 30, with the result that operability can be improved. Further, since the holder 250 is unlikely to rotate with respect to the shielded cable W when the metal shell 30 is mounted, the metal shell 30 can be more easily mounted.

Since the shield layer contact portions 243 are formed with the guide portions 243B for guiding the shield layer 13 to the contact surfaces 243A, the shield layer contact portions 243 can be smoothly brought into pressing contact with the shield layer 13 when the holder 250 is mounted. Further, since the metal shell contact portions 241 and the contact pressure assisting portions 244 are also formed with the guide portions 241B, 244A for guiding the metal shell 30 to a position outside them, the metal shell contact portions 241 can be smoothly brought into pressing contact with the metal shell 30 when the metal shell 30 is mounted.

Since the connection pieces 240 are formed with the contact pressure assisting portions 244, the shield layer contact portions 243 can be pressed against the shield layer 13. Therefore, the shield layer 13 and the connection pieces 240 can be connected more securely.

The invention is not limited to the foregoing embodiments, but may be embodied, for example, as follows. These embodiments are also embraced by the technical scope of the invention as defined in the claims.

Although the invention is applied to the male shield connector M in the foregoing embodiments, it may be applied to a female shield connector.

Although the contact portions 43, 73, 143, 173 are so formed as to be continuous with the rear ends of the fastening portion 42, 142 and the pressing portion 72, 172, respectively in the foregoing embodiments, they may extend from the receiving portions 41, 71, 141, 171 separately from the fastening portion 42, 142 and the pressing portion 72, 172.

Although the pressing pieces 142, 172 are integrally or unitarily formed with the receiving portions 141, 171 in the foregoing embodiments, the pressing pieces and the receiving portion may be separately formed and catch holes may be formed in a separately formed receiving member so that the leading ends of the pressing pieces can be caught in these holes. In this case as well, the pressing pieces have their rear ends pressed by the metal shell and are elastically deformed about their portions caught by the receiving member. In other words, the pressing pieces can press the shield layer by the action of lever, thereby ensuring a secure electrical connection and facilitating the pressing operation.

Although the pairs of the engaging projections 145 and the engaging recesses 146, the pairs of the lock projections 147 and the lock holes 148 are formed in the pressing pieces 142 and the receiving portion 141 in the first embodiment, they may be deleted from the construction or either former or latter pairs may be provided in the construction.

Although the rear end of the pressing piece 142 as a point of action for deforming the pressing piece 142 serves as a contact portion 144 with the metal shell 30 in the first embodiment, the contact portion may be formed in an other portion of the pressing piece or the contact portion separate from the pressing piece may be formed to project from the leading end of the receiving portion.

Although the receiving portions or members 141/171 are integrally or unitarily formed in the preceding embodiments, they may be circumferentially subdivided or split into two or more separate receiving portions or members, which may subsequently integrally or unitarily assembled.

Although the connection pieces 240 are formed with the contact pressure assisting portions 244 for increasing the contact pressure of the shield layer contact portions 243 in the foregoing embodiment, they may not have the contact pressure assisting portions 244.

Although the holder 250 is assembled with four connection pieces 240 arranged at substantially equal intervals in the foregoing embodiment, it is sufficient that the holder have one or more connection pieces.

Although the guide portions 241B, 244A for guiding the metal shell 30 to the position outside the connection pieces 240 are formed on the metal shell contact portions 241 and the contact pressure assisting portions 244, respectively, they may be formed on the metal shell.

Besides the following embodiments, a variety of changes can be made without departing from the spirit and scope of the present invention as defined in the claims.

What is claimed is:

1. A shield connector comprising:

a housing;

a shielded cable having an end in the housing, the shielded cable comprising a core, an insulation coating surrounding the core and a shield layer surrounding the insulation coating;

a shield tube between the housing and the end of the cable; and a connection member for electrically connecting the shield layer of the cable and the shield tube, the connection member comprising a receiving member inserted between the insulation coating of the cable and the shield layer thereof, pressing members unitarily connected to the receiving member and formed for pressing the shield layer against the receiving member; and a contact portion unitarily extending from the pressing members and contacting an inner circumferential surface of the shield tube.

2. A shield connector according to claim 1, wherein the receiving member is substantially tubular and extends along an inner circumferential surface of the shield layer, a coupling member extending unitarily between one end of the receiving member and the pressing members the pressing members being formed to substantially surround the receiving member.

3. A shield connector according to claim 1, wherein the pressing members comprise a pair of opposed serrated edges formed inwardly for forcibly fastening the shield layer to the receiving member.

4. A shield connector according to claim 1, wherein a portion of the core projects beyond the shield layer at the end of the cable, and wherein the shield tube is provided in the housing so as to substantially cover the core projecting from the shield layer.

* * * * *